US008297994B2

(12) United States Patent
Lee et al.

(10) Patent No.: US 8,297,994 B2
(45) Date of Patent: Oct. 30, 2012

(54) SWITCHING DEVICE HAVING AN INSULATING ENCLOSURE WITH A ROTARY COMPONENT AND AN INSPECTION ELEMENT WITH A DETECTION ELEMENT AND A TRANSMISSION MEMBER

(75) Inventors: Chiu-San Lee, Xindian (TW); Su-Chen Shen, Xindian (TW)

(73) Assignee: XYZ Science Co., Ltd., Taipei County (TW)

( * ) Notice: Subject to any disclaimer, the term of this patent is extended or adjusted under 35 U.S.C. 154(b) by 231 days.

(21) Appl. No.: 12/909,866

(22) Filed: Oct. 22, 2010

(65) Prior Publication Data

US 2012/0100733 A1 Apr. 26, 2012

(51) Int. Cl.
*H01R 29/00* (2006.01)

(52) U.S. Cl. ..... 439/172

(58) Field of Classification Search ..... 439/172, 439/166, 171, 173–176, 638
See application file for complete search history.

(56) References Cited

U.S. PATENT DOCUMENTS

| | | | | |
|---|---|---|---|---|
| 6,328,581 | B1 * | 12/2001 | Lee et al. | 439/106 |
| 6,330,144 | B1 * | 12/2001 | Lee et al. | 361/115 |
| 7,354,286 | B1 * | 4/2008 | Lee | 439/172 |
| 7,621,764 | B2 * | 11/2009 | Shunjie | 439/131 |
| 8,197,273 | B1 * | 6/2012 | Lee | 439/172 |
| 2002/0064983 | A1 * | 5/2002 | Patey | 439/152 |
| 2004/0253854 | A1 * | 12/2004 | Lee et al. | 439/106 |

* cited by examiner

*Primary Examiner* — Chandrika Prasad
(74) *Attorney, Agent, or Firm* — Leong C. Lei

(57) ABSTRACT

A multi-functional polarity-correcting plugging-coupling switching device includes a rotary component, which is rotatable and has at least one inspection element that is electrically connected to a touch control resistor and a live connection of a power plug. With a user using a hand to touch the touch control resistor, a closed circuit is formed with the human body for identifying correct position of polarization of the power plug. Further, through rotation of the rotary component, correct polarization and voltage level can be selected. Further, a resistive indicator is provided for indicating correct connection of earth line.

19 Claims, 28 Drawing Sheets

SWITCHING DEVICE HAVING AN INSULATING ENCLOSURE WITH A ROTARY COMPONENT AND AN INSPECTION ELEMENT WITH A DETECTION ELEMENT AND A TRANSMISSION MEMBER

TECHNICAL FIELD OF THE INVENTION

The present invention generally relates to a multi-functional switching device, and more particularly to a multi-functional polarity-correction plugging-coupling switching device that guides a user to properly use a plug so that the plug can be plugged in correct polarization setting.

DESCRIPTION OF THE PRIOR ART

Electrical power is one of the most commonly used power sources for general living of modern people and commercial and industrial activities. For a person traveling to a foreign country for sightseeing or business, small electrical appliances that consume small amounts of electrical power and/or equipped with means for conversion of alternating current into direct current are commonly carried. Based on such a need, various manufacturers and designers are devoted themselves in developing and manufacturing related electrical accessories for sharing the market and also for sales to foreign countries for compatibility with power supply lines. Since power plugs used in different areas are of different designs, it is even vital to provide a polarity-correcting electrical appliance that offers protection of the user against risk of electricity. One of the common solutions is to provide an earth line or a neutral line. This causes certain problems to the manufacturers and designers, for most of the commonly used electrical appliances are provided with a plug that has two pins or blades, including air driers, massage devices, chargers, and the likes. A different arrangement of the plug is of three pins or blades, of which an earth pin is often removed by a user either purposely or unintentionally. This increases the risk of electrical leakage and once an insulation jacket of a power cord is damaged and the power cord happens to be in a wetted condition, electrical shock may occur on a user. Further, plugging with incorrect polarization often leads to the generation of undesired electromagnetic radiation, which is detrimental to human health and the surroundings. Further, it is often possible to have a person knowledgeable in use and operation of electricity instructing a user how to properly use and operate electricity without being hurt by electrical shocking.

SUMMARY OF THE INVENTION

The primary objective of the present invention is that an insulation enclosure and a rotary component are included, wherein the insulation enclosure has a circumferential surface defining at least one position constraint slot, which functions to slidably receive an adjusting and rotating knob projecting from a side surface of the rotary component. The adjusting and rotating knob carries a touch control detection element thereon. The rotary component is received in the insulation enclosure and has a top portion exposed. The exposed portion forms a plurality of terminal compartments that receive pins or blades to fit therein. The rotary component comprises at least one inspection element mounted thereon and the inspection element is electrically connected to the touch control detection element and is also electrically connected to a transmission member mounted to a bottom of the rotary component. The transmission member is engageable with a conductive member for conducting. The conductive member is electrically connected to a live connection (L). Thus, when a user plugs the insulation enclosure to a power socket, the user uses a hand to touch the touch control detection element for formation of a closed circuit through the human body. If the transmission member electrically connected to the inspection element and the live connection (L) are conducting, then the inspection element is lit (which allows for further identification of the power socket being of 220V or higher level); otherwise, if the live connection is not plugged into a live bore of the power socket (meaning the polarization is reversed), then the user touching the touch control detection element with a hand does not form a closed circuit with the inspection element, so that the inspection element is not lit (which allows for further identification of the power socket being of 125V or lower level). In this way, the polarization and voltage level of a power socket can be correctly identified and a user may plug a device to the power socket with correct polarization setting, incorrect plugging being avoided. Further, when pins or blades of a power plug are fit into the terminal compartments, through operating the adjusting and rotating knob or directly rotating the power plug, the rotary component can be rotated to switch among different polarization settings and voltage levels. When a power socket supplies an electrical power of 110V, the rotary component can be rotated to a designated position associated with 110V voltage (where the live connection is located on the left side portion of the power plug); when the power socket supplies an electrical power of 220 V, the rotary component is rotated to a designated position associated with 220V (where the live connection is located on the right side portion of the power plug). With such a technique, the present invention is made to overcome the problems that risk of electrical leakage caused by unintentionally or purposely removing an earth pin from a plug, which may lead to electrical shock to a user in case a jacket of a power cable is damaged in a wetted condition, may be increased, electromagnetic radiation, which is detrimental to the user and the surroundings, may be caused by plugging with incorrect polarization, people who are not knowledgeable of use and operation of electrical power may get electrically shocked without being instructed by people having ordinary skills of operation of electricity. Thus, the present invention suits the needs of contemporary society, allowing people to instantaneously cut off power supply when there is no need to consumer electrical power, and additionally, the device of the present invention provides an additional function of a fuse for protection against risks of electricity and may provide a guide for correct polarization setting, reducing resistivity and suppressing damage of human body caused by electromagnetic radiation, and is also helpful in reduction of energy consumption and carbon generation, making it advanced in environmental conservation.

Another objective of the present invention is that through the alteration in structure as described above, the device of the present invention is operable for plugging coupling, ON/OFF switching, and 360 degree rotation for applications for diverse plugging coupling electrical accessories, including transformer, rectifier, socket, extension cord socket, and adapter.

A further objective of the present invention is that a resistive indicator is arranged between an earth connection and a live connection (L) so that through identifying the indicator being lit or not, correct connection of the earth connection can be determined.

Yet a further objective of the present invention is that the power plug mentioned above further comprises a conduction switch that comprises a slide track, a push block slidably mounted on the slide track, a conduction and connection plate coupled to the push block and a first connection/disconnection plate electrically connected to a live connection of the power plug, the connection/disconnection plate being made of a fusible material, and a second connection/disconnection plate adjacent to the first connection/disconnection plate. The power plug also comprises a touch control detection element and an inspection element electrically connected to the touch control detection element. The inspection element is also electrically connected to the live connection, whereby when a user does not intend to use the power plug, through movement of the push block along the slide track, the conduction and connection plate is moved away from the first connection/disconnection plate; on the other hand, when there is an attempt to use the power plug, the push block is moved in such a way to have the first connection/disconnection plate and the second connection/disconnection plate are set in electrical conduction with each other through the conduction and connection plate. Further, a user may touch the touch control detection element, and if the inspection element is lit, it is identified that the connection is live connection (L). Through the operation of the conduction switch, the power plug can be actively shut down for electrical supply. Further, with the touch control detection element and the inspection element, a user may easily identify the correct position of the live connection (L), making it effective in preventing overloading of power source, suppressing the occurrence of fire, and preventing incorrect conduction or reversed polarization, and allowing for instantaneously cutting off power supply.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
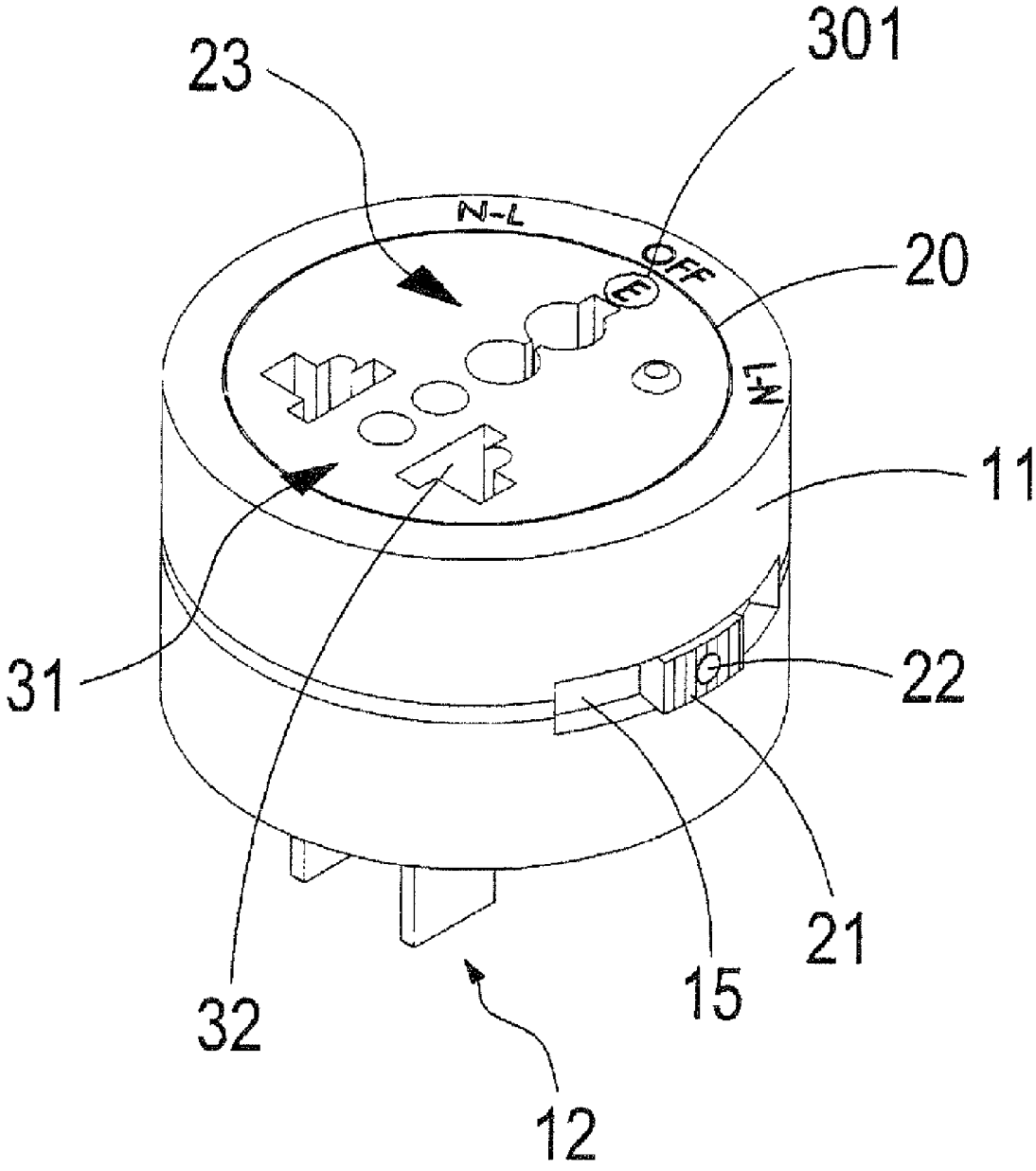
FIG. 1 is a perspective view of a preferred embodiment according to the present invention.

Referring to FIGS. 1, 2, 3, 3A, 3B, 4, 4A, 5, and 5A, which are respectively a perspective view and a cross-sectional view of a multi-functional polarity-correcting plugging-coupling switching device according to a preferred embodiment of the present invention, a top plan view of an insulation enclosure of the switching device, and first to sixth illustrations of polarization setting of the switching device, the switching device of the present invention comprises an insulation enclosure 11, a rotary component 20 (which has a surface forming a socket panel 31) received in the insulation enclosure 11 and rotatable, in a limited manner, along a circumferential surface 131 of an opening 13, which will be further described hereinafter, and at least one inspection element 30, 301 (of which the inspection element 301 is arranged inside the marking of "E" connection in FIG. 1) mounted at a predetermined location on the switching device. The inspection element 30, 301 can be for example a lighting element (such as a light-emitting diode (LED)) or a sounding element. The inspection element 30 is temporarily located above an electrical connection line of "L" connection (which is "live" connection for 250V) of a right-side socket 32 formed in the socket panel 31, and temporarily serves, together with a touch control detection element 22 (which will be described hereinafter), as the L connection for 250V, providing a measure, when being lit, for determining other polarization arrangement, of which details will be described hereinafter. The insulation enclosure 11 has an end (bottom) to which a conductive pin set 12, which is polarization dependent, is mounted and an opposite end (top) forming the opening 13. The conductive pin set 12 is mounted to and extends through a mounting board 130. The mounting board 130 is fixed to the bottom end of the insulation enclosure 11 and the mounting board 130 fixedly supports the conductive pin set 12 that extends therethrough. The conductive pin set 12 comprises a first pin 121 (which defines a live pin (L) in a 220V socket or alternatively, a neutral pin (N) in an 110V socket), a second pin 122, and an earth pin 123. The first pin 121 and the second pin 122 are respectively connected to conductive members 14, 141 at the portions thereof extending through the mounting board 130. The conductive members 14, 141 are of polarization positions engageable with extensions of L and N connections in order to allow surface sockets of the rotary component to switch between various polarization settings and are provided with polarization positions 14L, 141L (or polarization positions 14L1, 141L1) of L connection. The conductive member 14 is connected to the first pin 121 and the conductive member 141 is provided with the polarization positions 141N, 141N1 (or polarization positions 14N1, 141N1) of N connection. The conductive member 141 is connected to the second pin 122. (The conductive members 14, 141 may further comprise a fusible metal plate or a conductive substance that becomes open-circuited when being subjected to a high temperature.) Further, the insulation enclosure 11 has a circumferential surface forming at least one position constraint slot 15, which functions to slidably receive an adjusting and rotating knob 21 projecting from a side surface of the rotary component 20. The adjusting and rotating knob 21 carries the touch control detection element 22 thereon. (The touch control detection element 22 can be a touch-control resistor.) The touch control detection element 22 is in electrical connection with the inspection element 30 that is mounted on the rotary component 20. The rotary component 20 forms a plurality of terminal compartments 23 electrically connectable with the conductive pin set 12. The terminal compartments 23 have a bottom to which a transmission member 24, 24*a*" in electrical connection with the inspection element 30 is mounted. The transmission member 24, 24*a*" forms a conductive contact surface 241 that extends outward of the terminal compartment 23. Further, the transmission member 24 is operated with the rotation of the rotary component 20 that leads to movement for engagement with the conductive member 24 for formation of various polarization arrangement and for plugging coupling and ON/OFF switching. Further, the earth pin 123 of E connection is provided with an interrupted earth line indicator contact tab 142".

Figure 3:
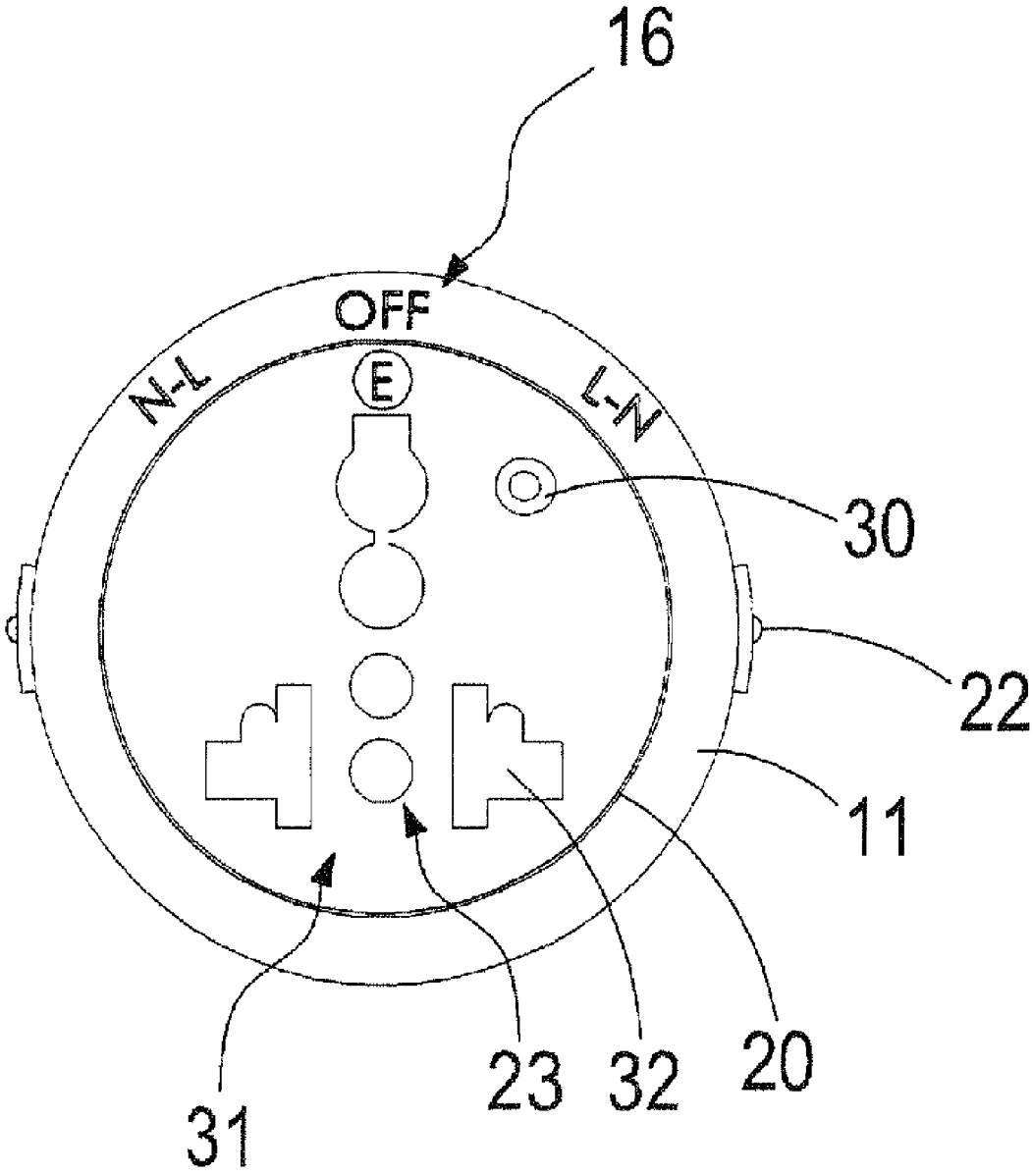
FIG. 3 is a top plan view of an insulation enclosure of the preferred embodiment of the present invention.
Figure 3A:
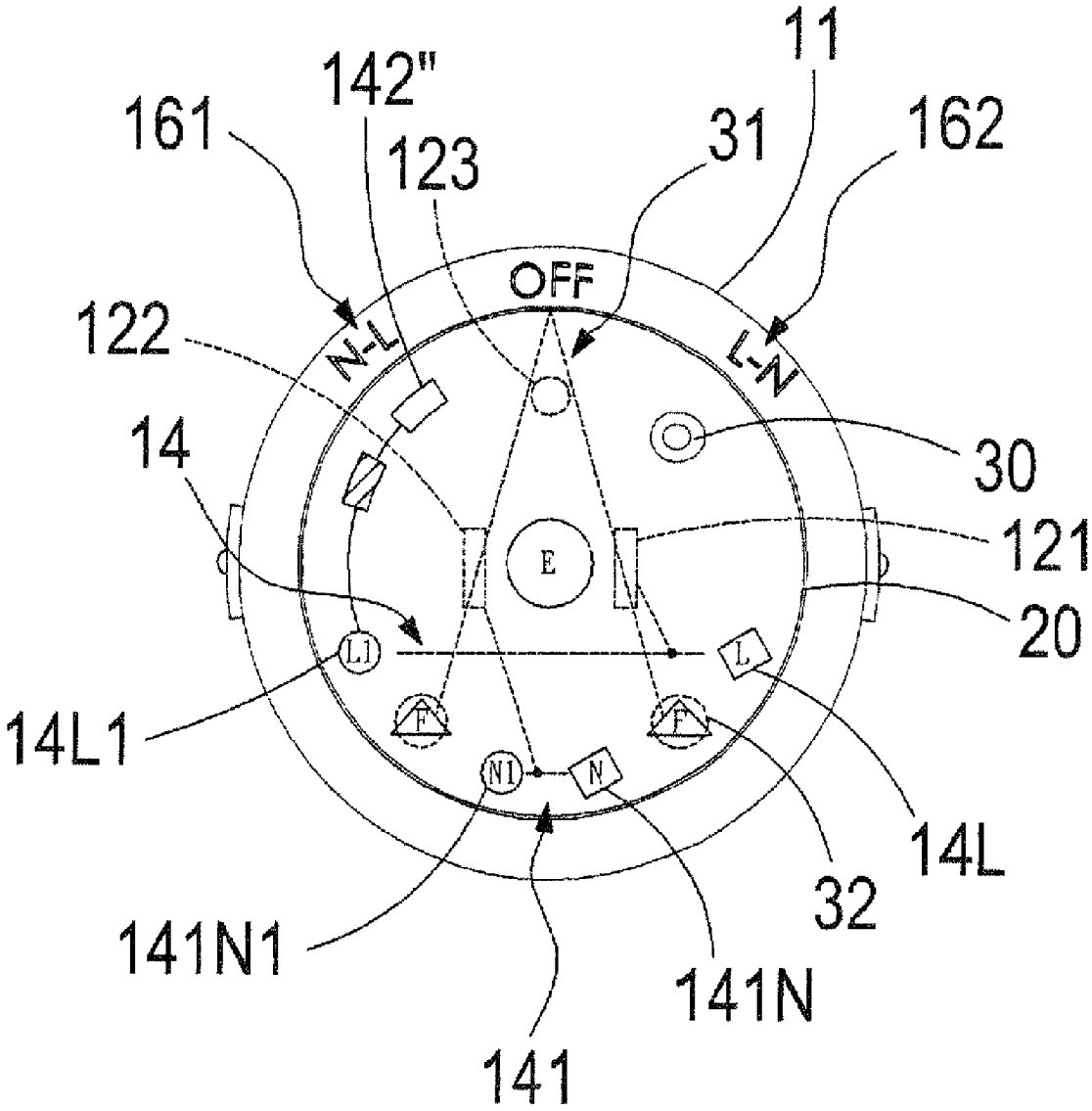
FIG. 3A is a first illustration of polarization setting of the preferred embodiment of the present invention.
Figure 3B:
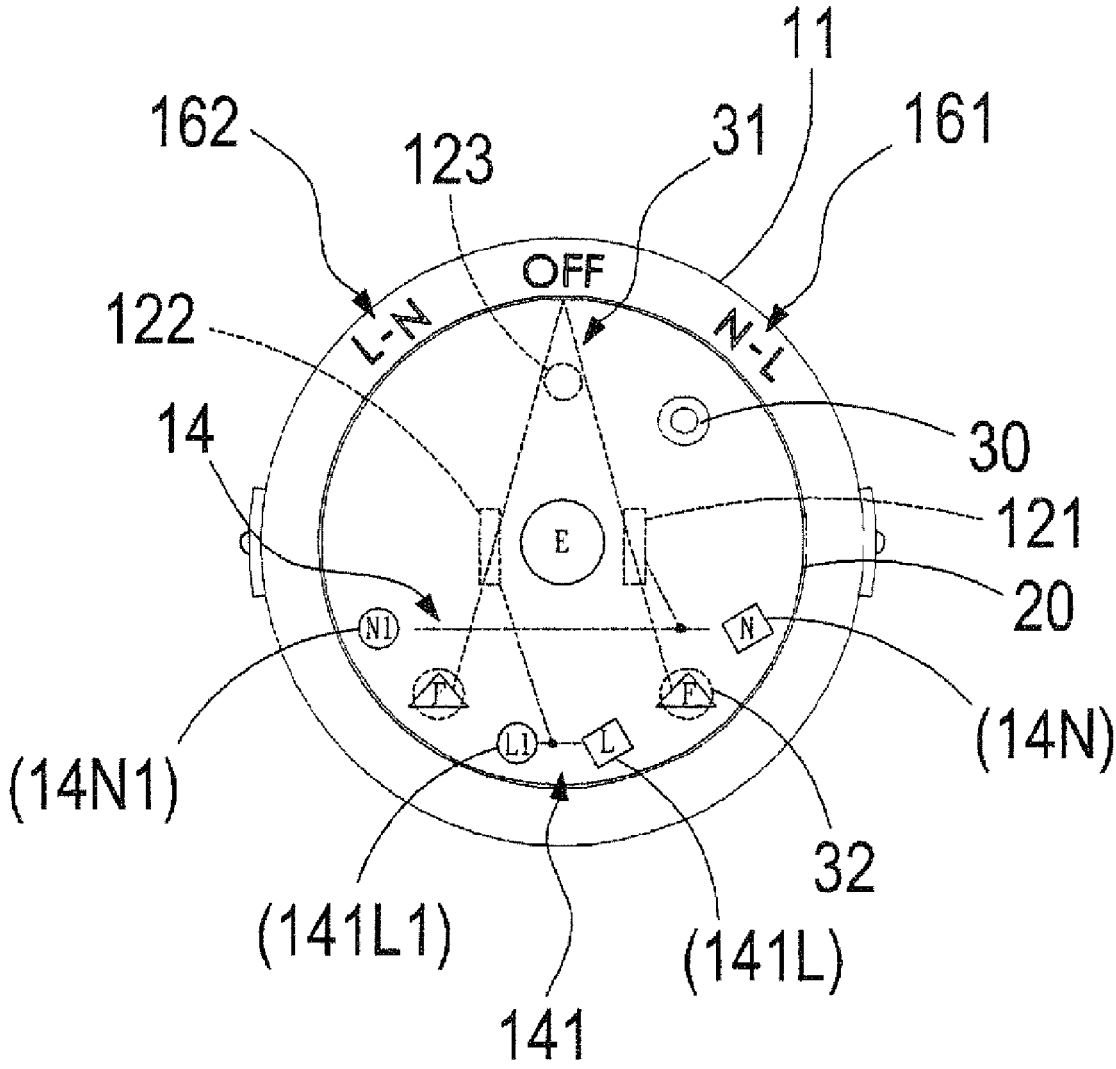
FIG. 3B is a second illustration of polarization setting of the preferred embodiment of the present invention.
Figure 4:
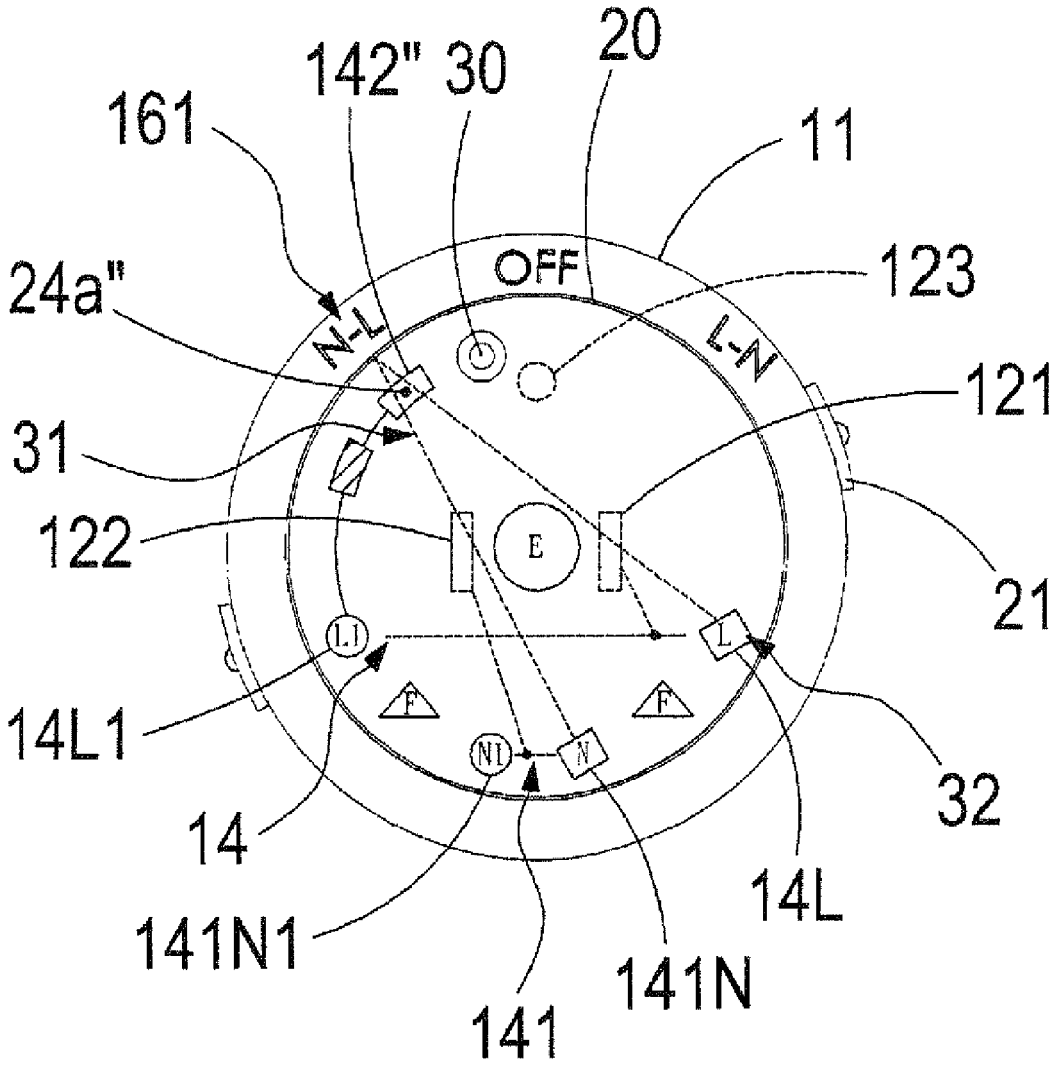
FIG. 4 is a third illustration of polarization setting of the preferred embodiment of the present invention.
Figure 4A:
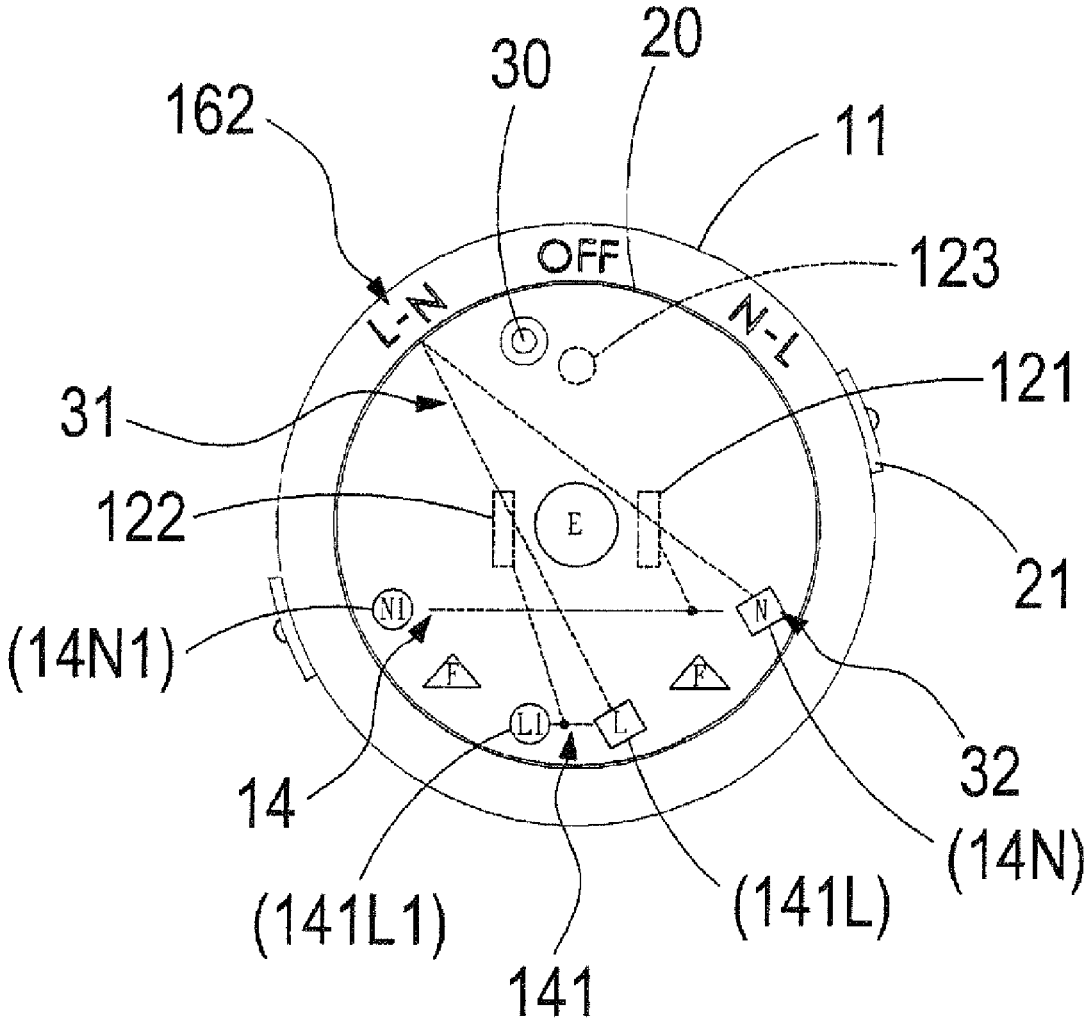
FIG. 4A is a fourth illustration of polarization setting of the preferred embodiment of the present invention.
Figure 5:
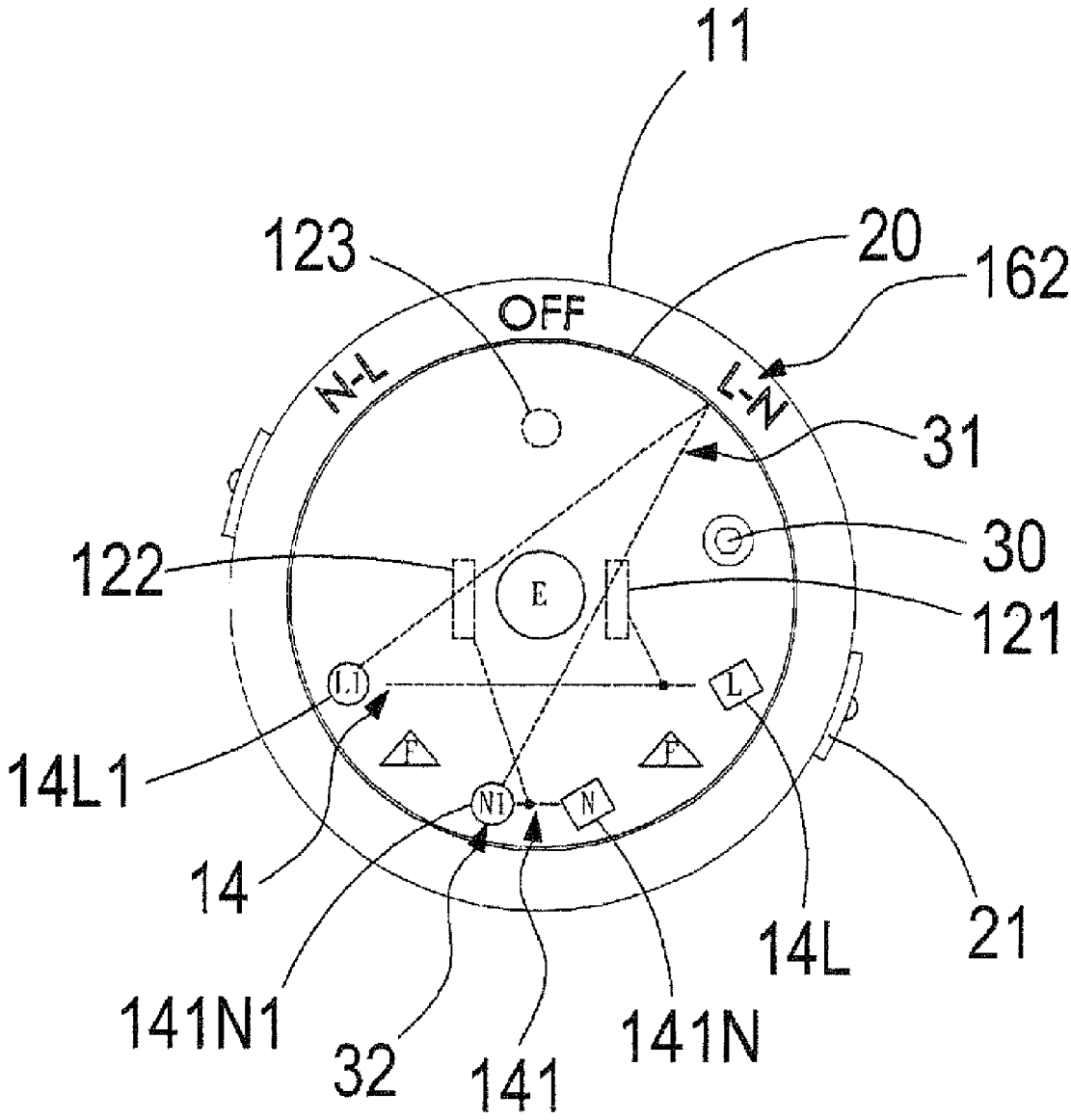
FIG. 5 is a fifth illustration of polarization setting of the preferred embodiment of the present invention.
Figure 5A:
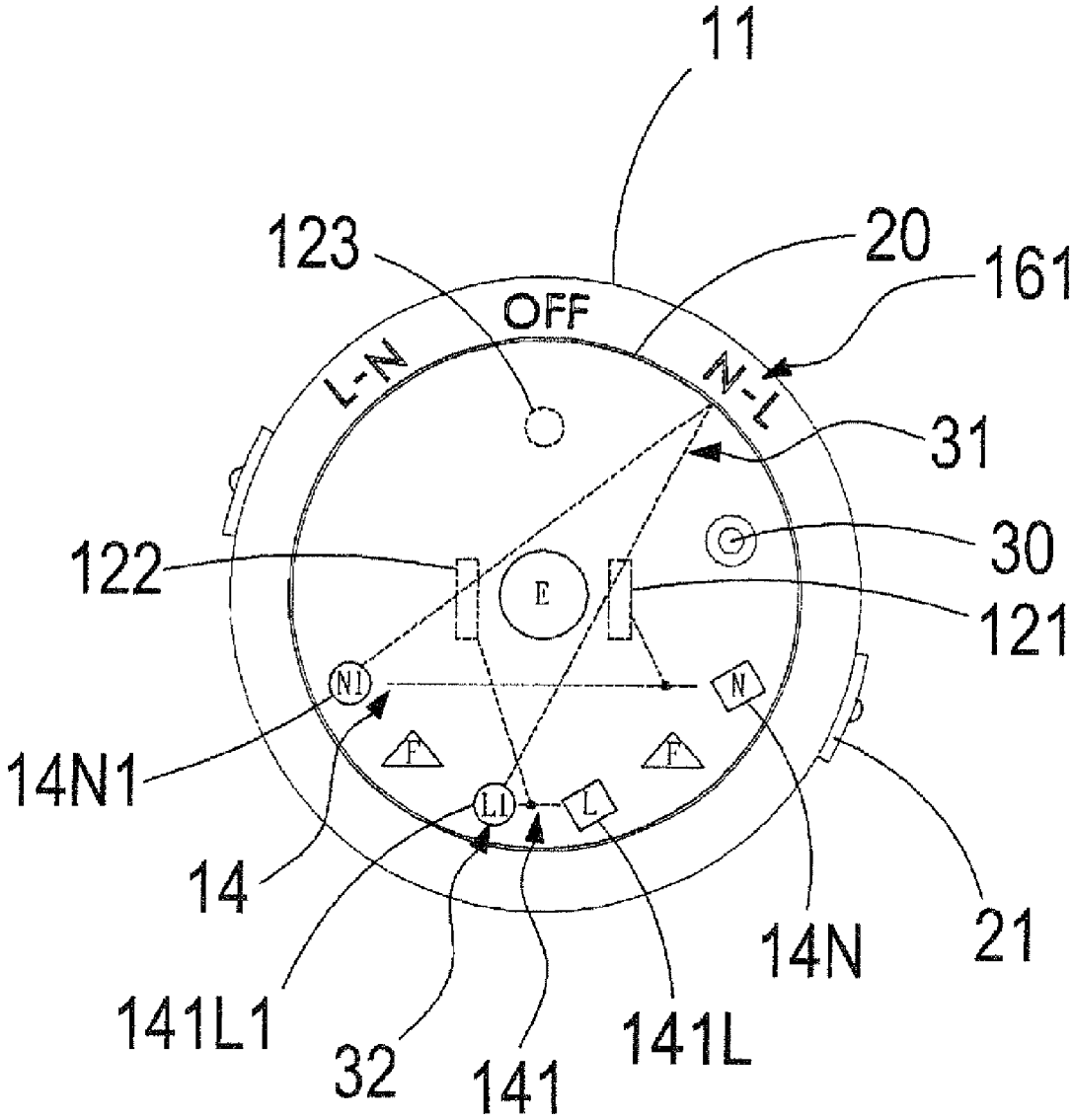
FIG. 5A is a sixth illustration of polarization setting of the preferred embodiment of the present invention.
Figure 6:
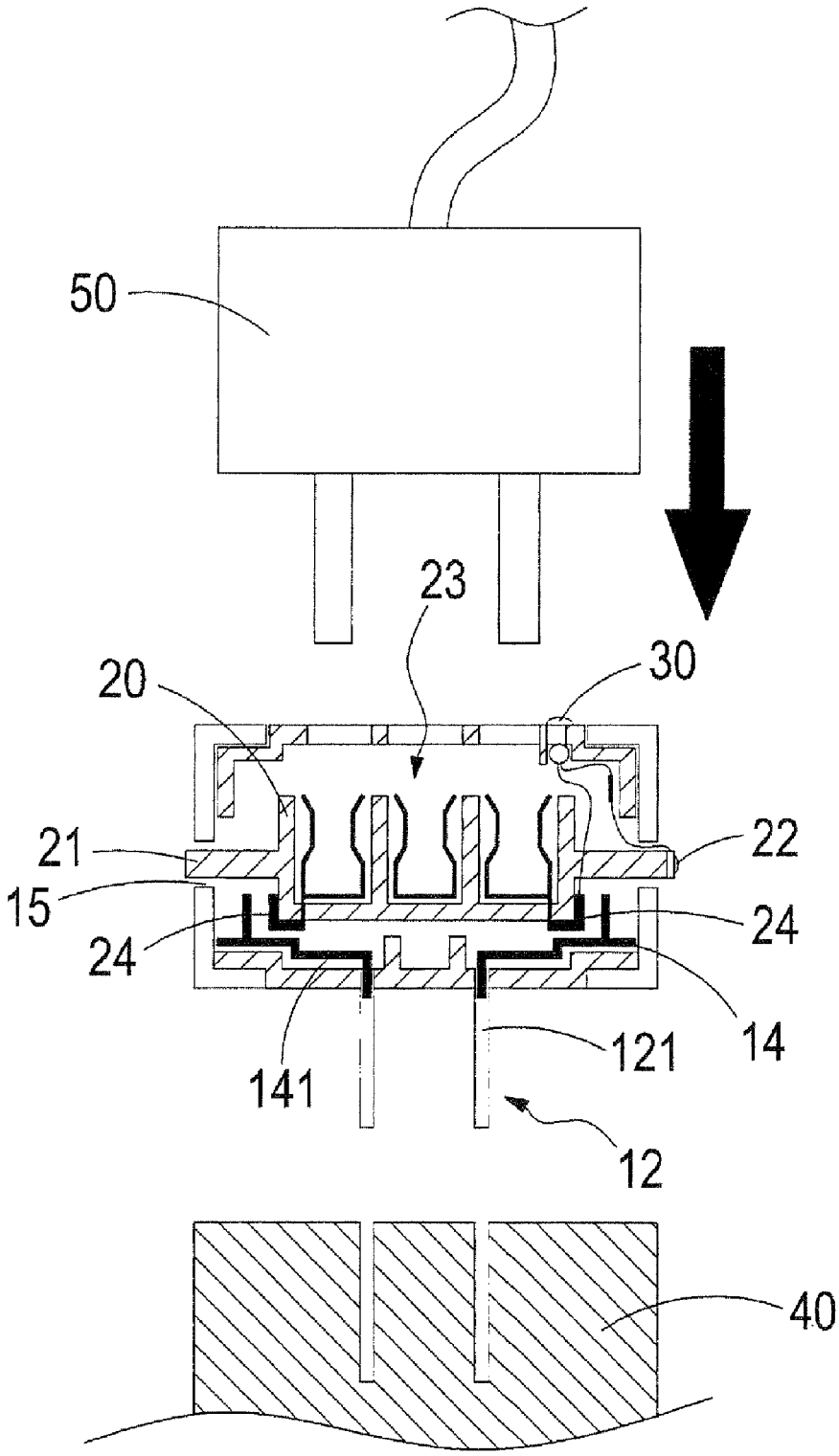
FIG. 6 is a first illustration of plugging operation of the insulation enclosure of the preferred embodiment of the present invention.
Figure 7:
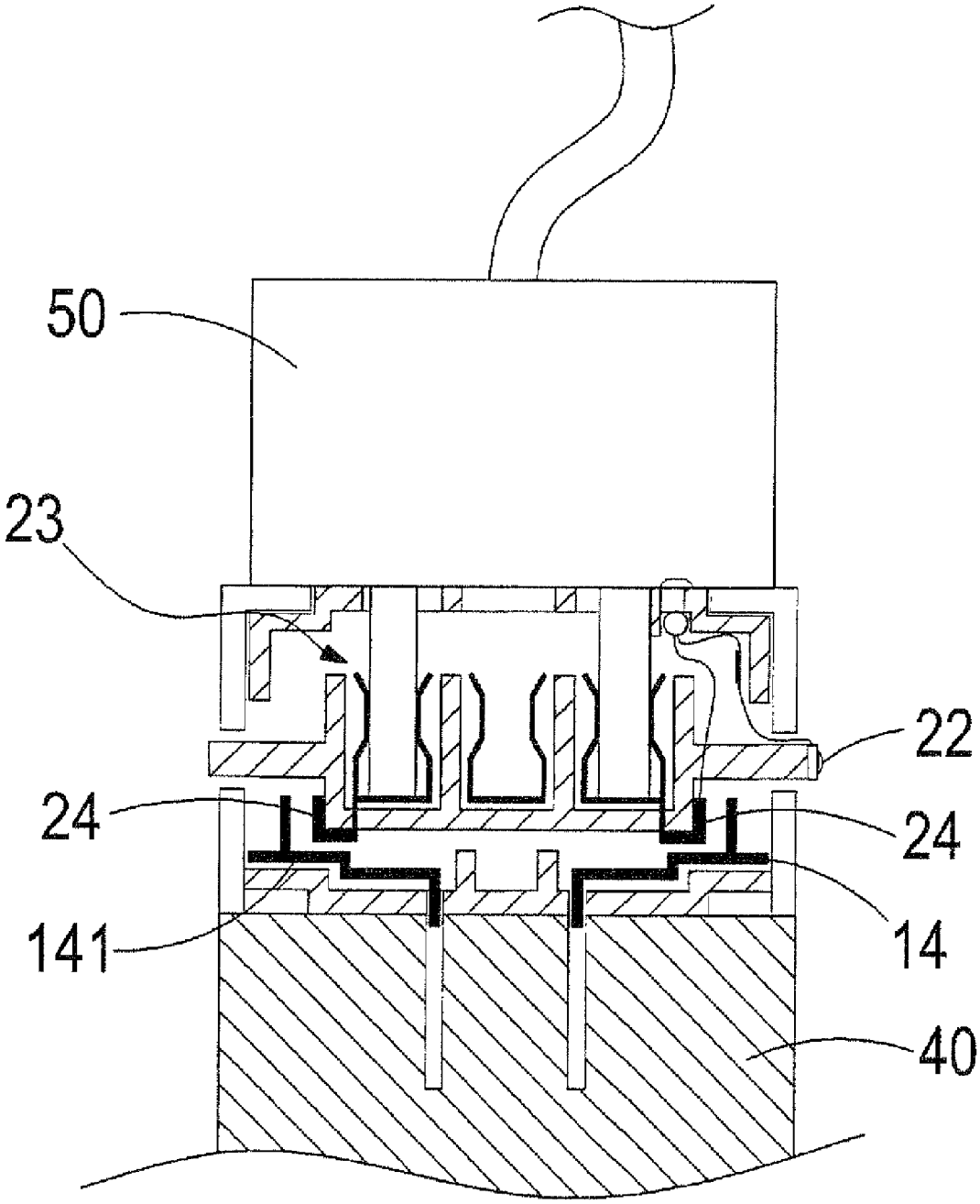
FIG. 7 is a second illustration of plugging operation of the insulation enclosure of the preferred embodiment of the present invention.

Further, the insulation enclosure 11 forms indication marks 16 of "OFF" and polarization arrangement adjacent to the opening 13. The insulation enclosure 11 has a top having a central portion in which a rotary component 20 is mounted. The rotary component 20 forms a plurality of terminal compartments 23 that is capable of receiving external pins or blades to fit therein. Through detection performed with the rotary component 20, output voltage and polarization position can be identified. The terminal compartments 23 of the rotary component 20 respectively correspond in position to the transmission members 24 of the polarities of connection and generally define three designated positions, of which the first one is an "OFF" position of the switching device (taking FIG. 3A as an example, wherein the right-side socket 32 for 220V is set at "F", which is in a neutral position; FIG. 3B showing the right-side socket 32 for 110V set at "F", which is a neutral position), the second one is first designated position 161, which as shown in FIG. 4 is that the right-side socket 32 for 220V socket is set to 14L, which is live connection (L), and the third one is the second designated position 162, which as shown in FIG. 5 is that the right-side socket 32 for 220V socket is set to 141N1 (in order to allow a 110V device to switch to a polarization arrangement of left side "L" and right side "N" after voltage transformation). When the rotary component 20 is rotated to the first designated position 161, the first pin 121 and the second pin 122 correspond to and engage the polarization positions 14L and 141N; otherwise, when the rotary component 20 is rotated to the second designated position 162, the first pin 121 and the second pin 122 correspond to and engage the polarization positions 14L1 and 141N1. Further, when FIGS. 4 and 5A are of a system of 110V voltage, the first designated position 161 and the second designated position 162 and NL markings are different, but the remaining is the same as that discussed above. Further, the rotary component 20 is provided with the inspection element 30 for inspection and identification of polarization arrangement.

Further, the rotary component 20 comprises a safety member 232 mounted therein, and the earth pin 123 is provided with an interrupted earth line contact tab 142.

Figure 1A:
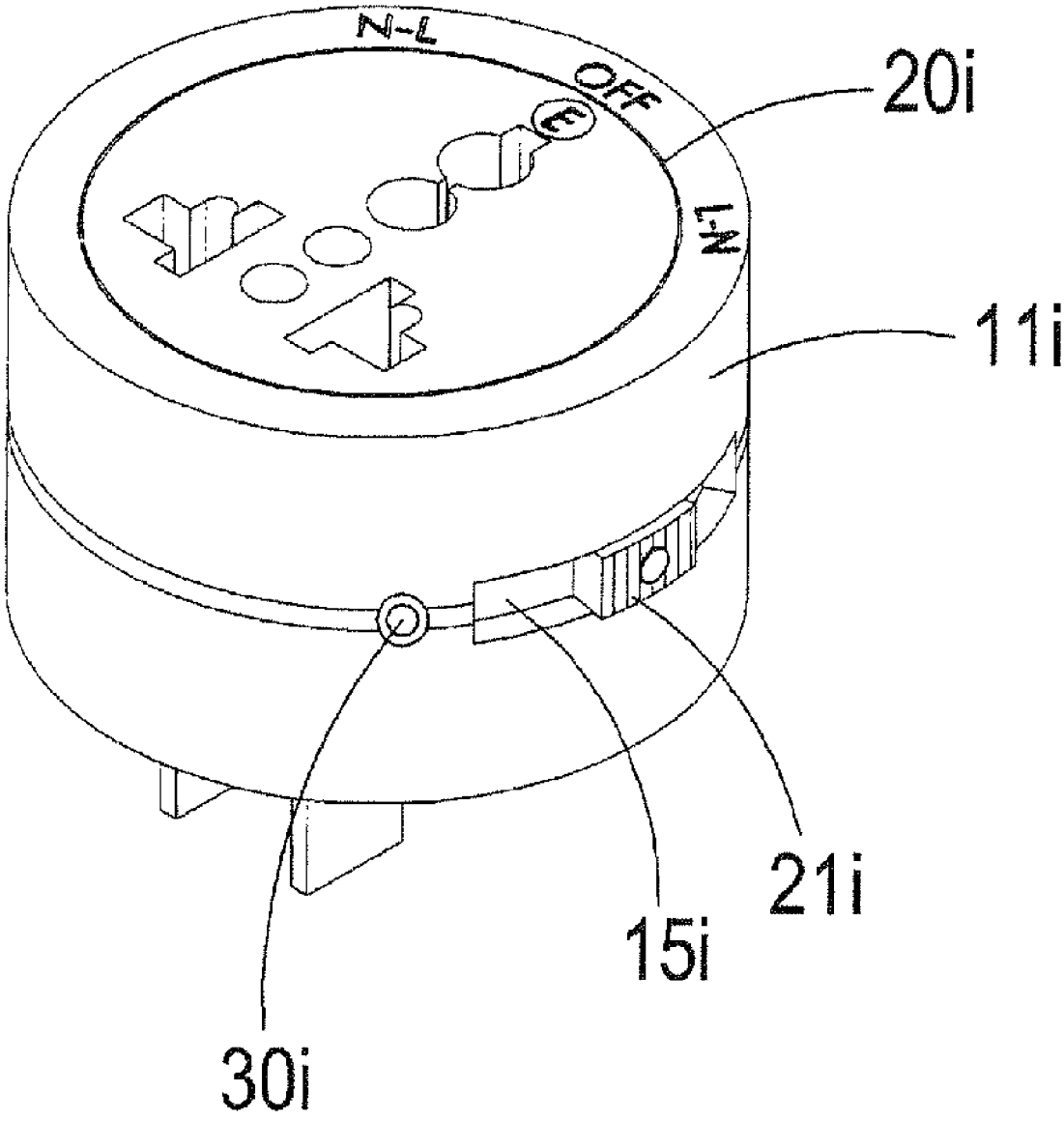
FIG. 1A is a perspective view of another preferred embodiment according to the present invention.
Figure 2:
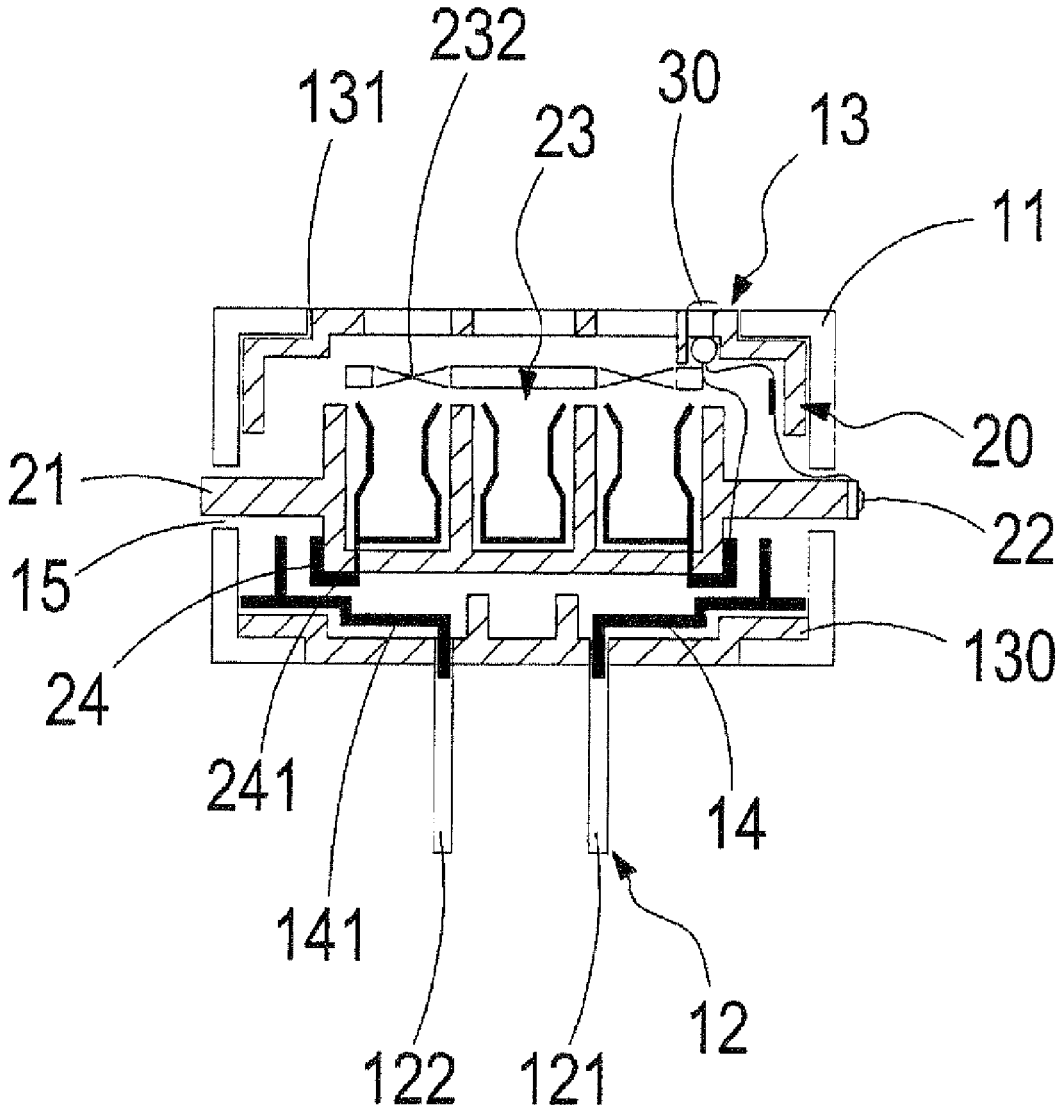
FIG. 2 is a cross-sectional view of the preferred embodiment according to the present invention.

Further, referring to FIG. 1A, which shows a perspective view of another preferred embodiment of the present invention, the insulation enclosure 11*i* has a circumferential surface forming a position constraint slot 15*i*, the position constraint slot 15*i*, which functions to slidably receive an adjusting and rotating knob 21*i* projecting from a side surface of the rotary component 20*i*. The inspection element 30*i* is arranged besides the position constraint slot 15*i* for easy inspection by a user.

Referring to FIGS. 2-7, which are respectively a cross-sectional view of a multi-functional polarity-correcting plugging-coupling switching device according to a preferred embodiment of the present invention, a top plan view of an insulation enclosure of the switching device, first to sixth illustrations of polarization setting of the switching device, and first and second illustrations of plugging operation of the insulation enclosure, the conductive pin set 12 is set engageable with a power socket 40, for a user must realize the supplied voltage of either 110V or 220V of the area where the user is located in order to match an electrical device used. If the supplied voltage is not matched, then transformation of voltage must be made to match the voltage consumable by the electrical device. (Most of the portable electrical devices are fit for both 110V and 220V and an alternating current can be converted into a direct current, so that the use of the electrical device is not subjected to constraints.) Then, when the conductive pin set 12 is plugged into the power socket 40 (the transmission member 24 and the conductive member 14, 141 being set in engagement with each other in the manufacturing and assembling process of the switching device), a user uses a hand to touch the touch control detection element 22 for inspection. Under this condition, since the inspection element 30 are in electrical connection with the transmission member 24 and the touch control detection element 22, if the first pin 121 is connected to an L connection socket bore, then the touch of the touch control detection element 22 by the user leads to formation of a closed circuit through human body, which lights up the inspection element 30, so that it can be identified that the first pin 121 is now of the L connection; otherwise, if the first pin 121 is connected to a non-L connection socket bore, when the user touches the touch control detection element 22, the inspection element 30 does not form a closed circuit due to being of the same polarity and thus the inspection element 30 is not lit, so that the user may identify that the first pin 121 is of N connection. Further, when the first pin 121 is of L connection, it indicates that the power socket 40 supplies an electrical power of 220V, and if the first pin 121 is of N connection, then the power socket 40 supplies 110V. Since the user has correctly identified the polarization arrangement or setting, the user may use the terminal compartments 23 for plugging coupling with a power plug 50. In the rotation of the rotary component 20 toward a desired designated position of polarization, the rotation of the rotary component 20 can be performed by a user through the power plug 50, or through the adjusting and rotating knob 21, wherein the adjusting and rotating knob 21 is moved within the position constraint slot 15 of position adjustment. Further, the conductive member 14, 141 may be a fusible metal plate or made of a conductive substance that becomes open-circuited when being subjected to a high temperature, so that when operation temperature of the switching device is excessively high, the conductive member is fused off and becomes open-circuited, for also serving as a fuse.

Figure 8:
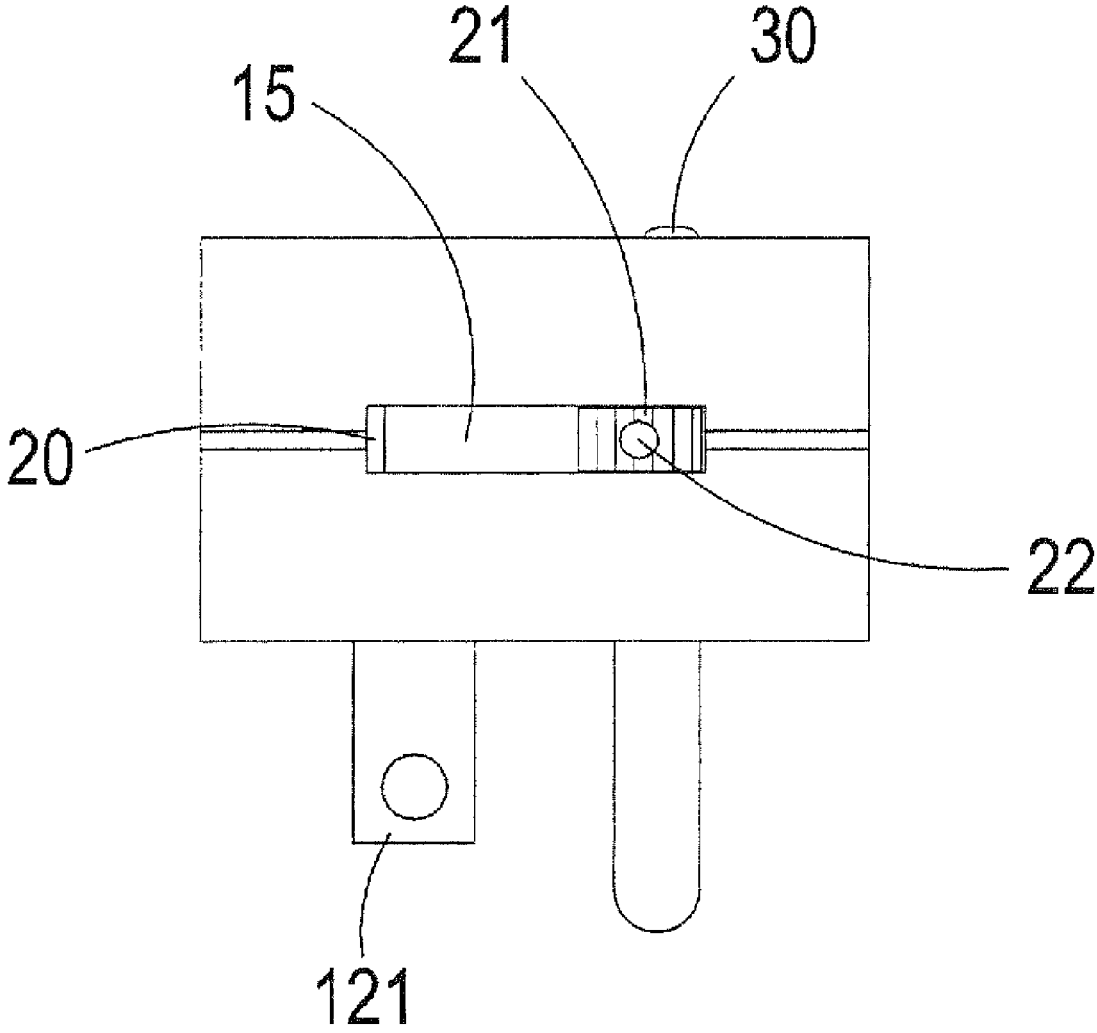
FIG. 8 is a first illustration of an operation of a preferred embodiment of an adjusting and rotating knob according to the present invention.
Figure 8A:
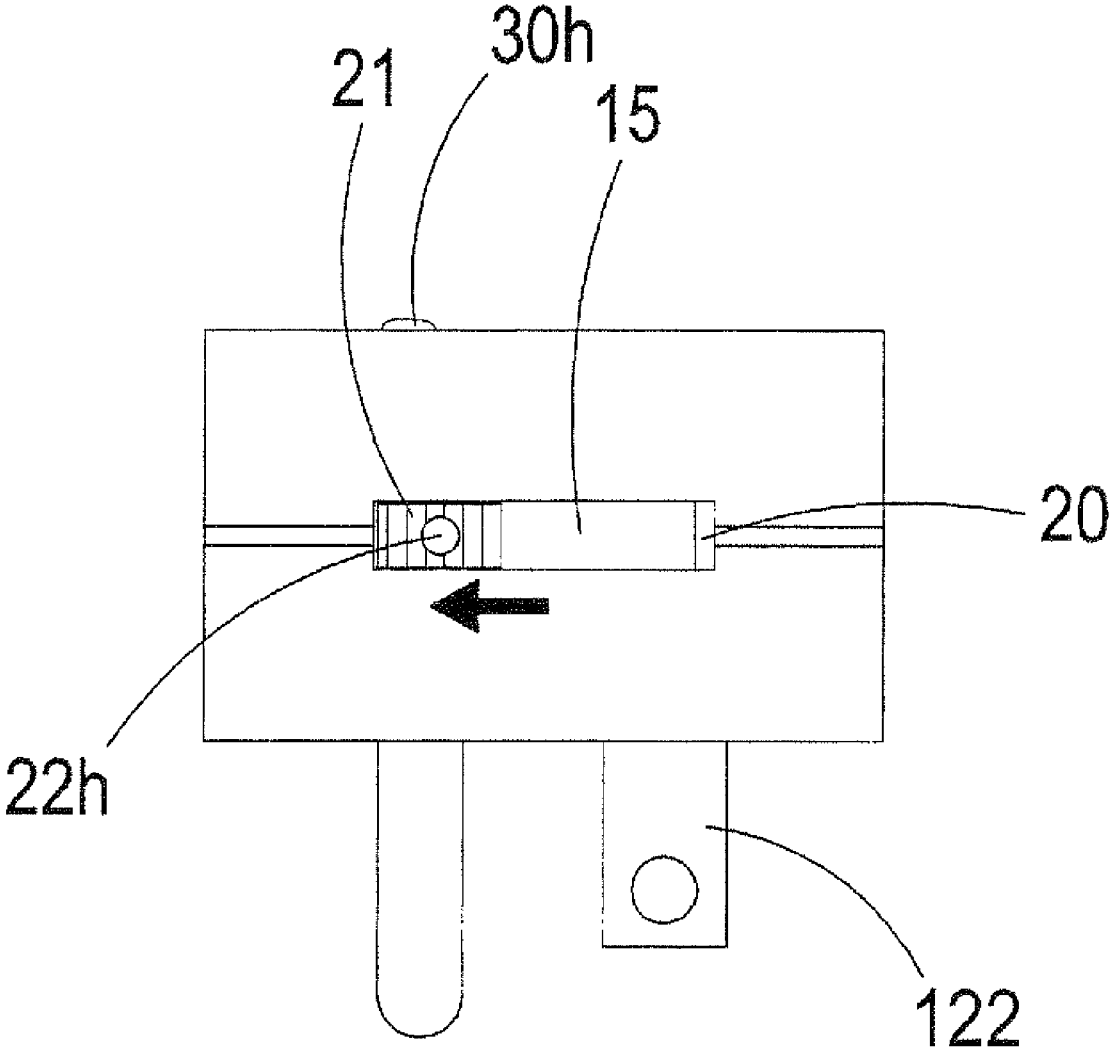
FIG. 8A is a second illustration of an operation of a preferred embodiment of an adjusting and rotating knob according to the present invention.

Referring to FIGS. 8 and 8A, which are first and second illustrations of the operation of a preferred embodiment of the adjusting and rotating knob according to the present invention, the adjusting and rotating knob 21 is allowed to take movement within the range defined by the position constraint slot 15. To change position for re-arrangement of polarization, the adjusting and rotating knob 21 is operated to rotate the rotary component 20 for switching polarization arrangement, whereby a user is allowed to make plugging connection with power supply system of different voltage levels and diverse polarization arrangements at various locations for realization of universal and multi-functional applications. (Particularly, the touch control detection element 22 and the inspection element 30 can be of symmetric arrangement of counterpart elements 22*h*, 30*h* on the opposite side to realize lighting indication for inspection and identification of L connection for 110V or 220V.) Further, the rotary component is electrically connected to the first pin 121 or the second pin 122.

Figure 9:
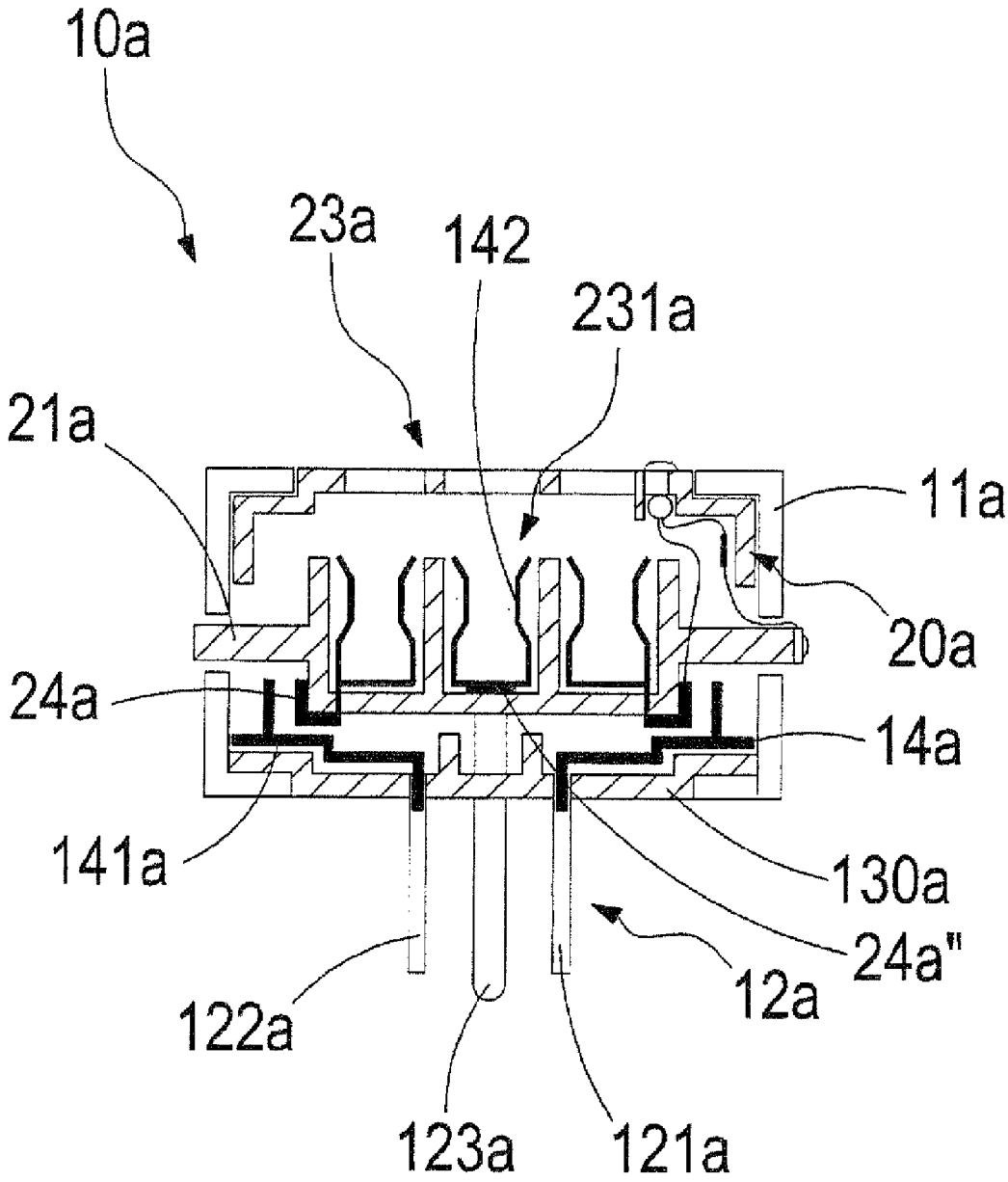
FIG. 9 is a cross-sectional view of a first preferred embodiment according to the present invention.

Referring to FIG. 9, which shows a cross-sectional view of a first preferred embodiment according to the present invention, a switching device 10*a* comprises an insulation enclosure 11*a*. The insulation enclosure 11*a* receives therein a rotary component 20*a*, which forms terminal compartment 23*a* and has an end to which a polarization dependent conductive pin set 12*a* is mounted. The conductive pin set 12*a* comprises a first pin 121*a* and a second pin 122*a*. The first pin 121*a* and the second pin 122*a* are mounted to and extend through a mounting board 130*a* and are each connected to a conductive member 14*a*, 141*a*. The conductive pin set 12*a* further comprises an earth pin 123*a* of E connection. Further, the terminal compartments 23*a* comprise an earth connection compartment 231*a* corresponding to and connected to the earth pin 123*a*. Particularly, the E connection earth pin 123*a* is provided with an interrupted earth line indicator contact tab 142, the earth line indicator contact tab 142 is connected through a resistive indicator to have a distal end connected to a live connection of L connection, whereby a transmission member 24*a*" of E connection is selectively set to connect the earth line indicator contact tab 142 by the adjustment and rotation of the adjusting and rotating knob 21*a*. Thus, correct connection of the E connection of earth line can be identified through lighting of the inspection element indicates; otherwise no lighting indicates E connection fails to properly function. Consequently, the switching device can be used for plugging coupling with a three-pin power plug.

Figure 10:
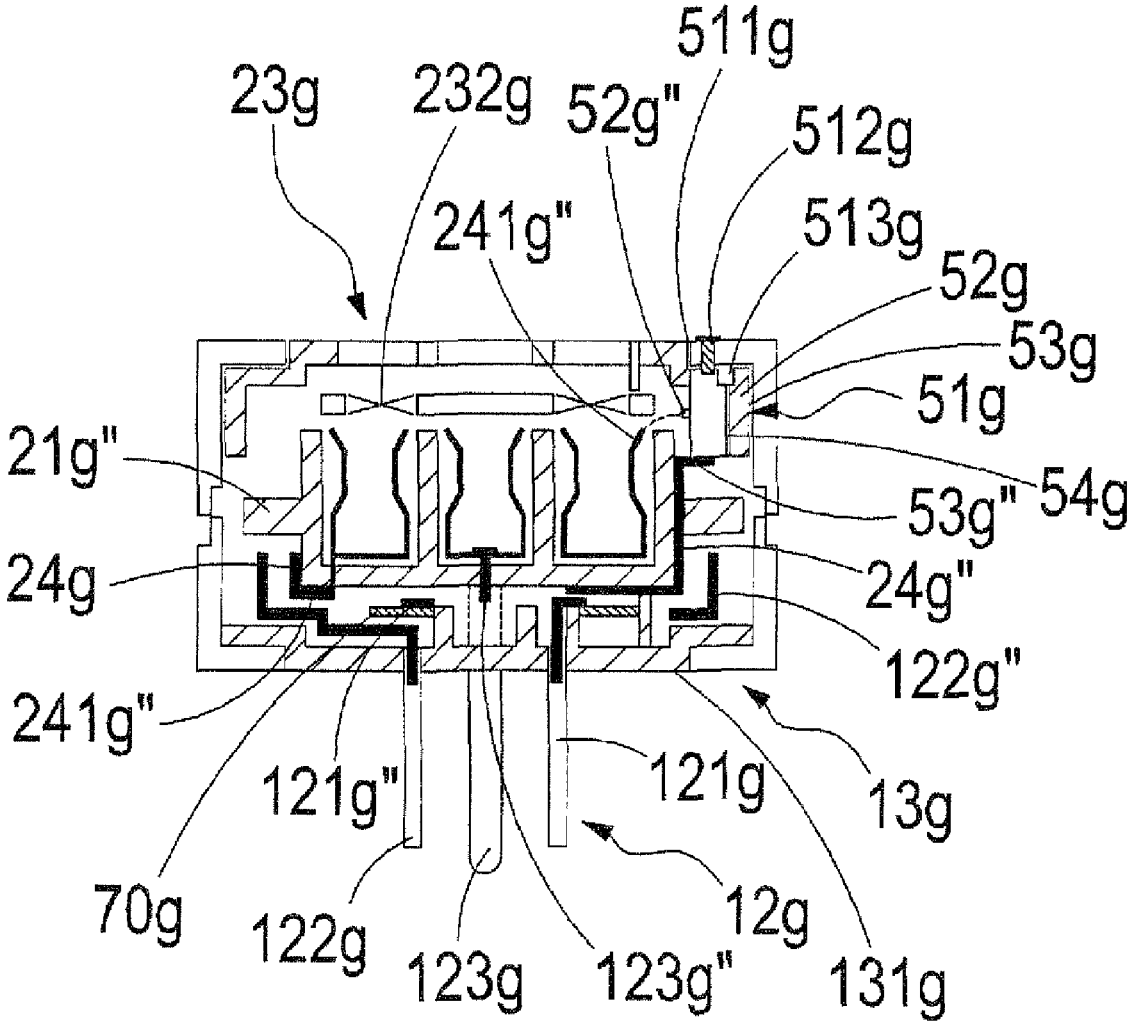
FIG. 10 is a cross-sectional view of a second preferred embodiment according to the present invention.
Figure 10A:
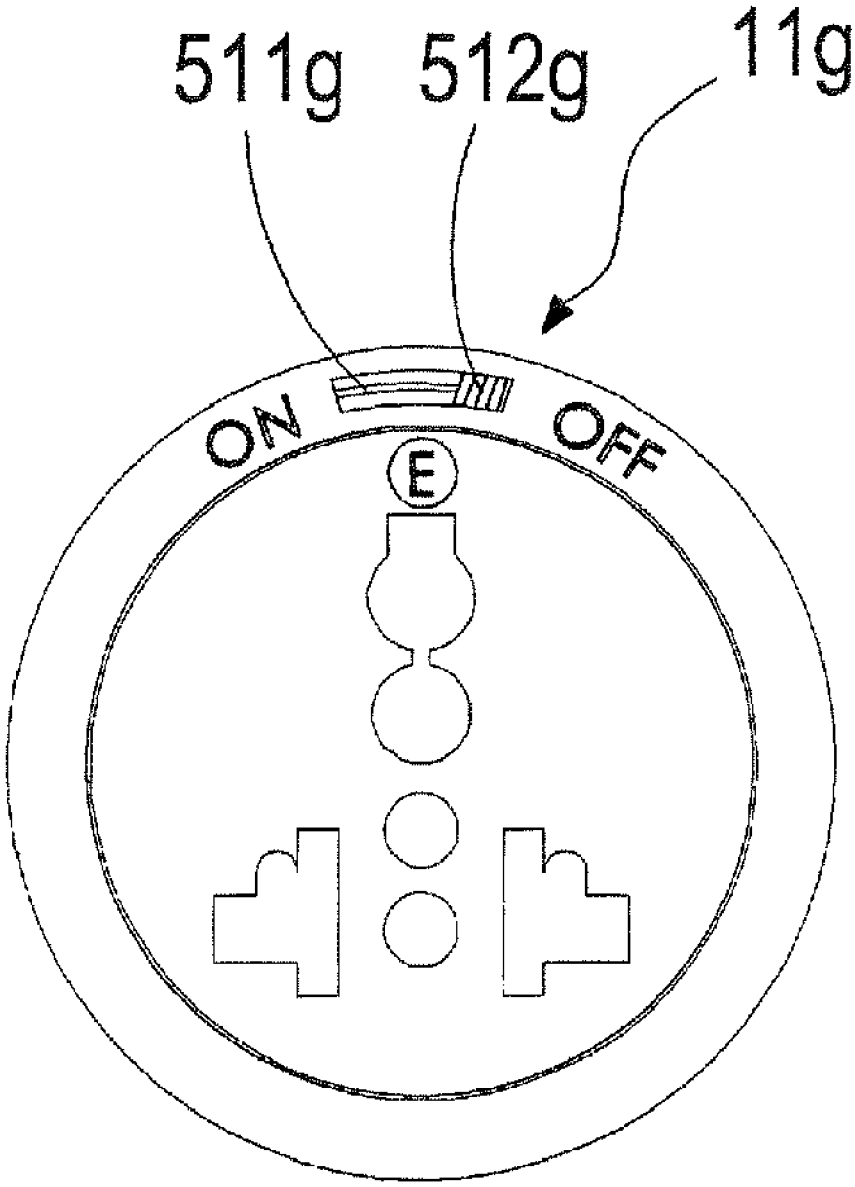
FIG. 10A is a top plan view of the second preferred embodiment according to the present invention.
Figure 10B:
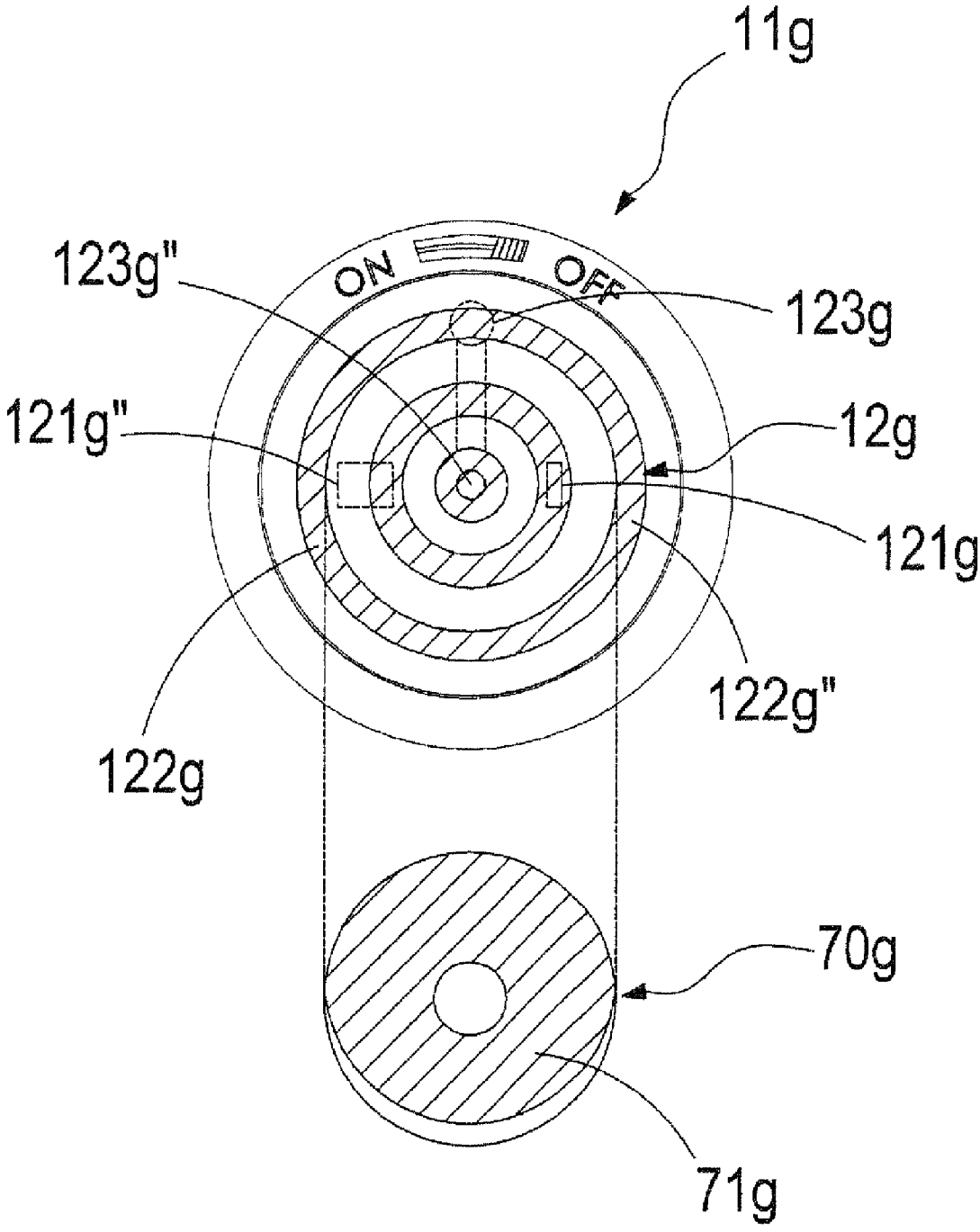
FIG. 10B is a schematic view of a rotation track of the second preferred embodiment according to the present invention.

Referring to FIGS. 10, 10A, and 10B, which respectively show a cross-sectional view and a top plan view of a switching device according to a second preferred embodiment of the present invention and a schematic view of rotation track of the switching device, the switching device comprises an insulation enclosure 11*g* and a rotary component received in the insulation enclosure 11*g* and rotatable, in a limited manner, along a circumferential surface 131*g* of an opening 13*g*, which will be further described hereinafter. (The rotary component forms an adjusting and rotating knob 21*g*".) The insulation enclosure 11*g* has an end to which a conductive pin set 12*g*, which is polarization dependent, is mounted and an opposite end forming the opening 13*g*. The conductive pin set 12*g* comprises first pins 121*g*, 121*g*", second pins 122*g*, 122*g*", and earth pins 123*g*, 123*g*". The rotary component forms a plurality of terminal compartments 23*g* electrically connectable with the conductive pin set 12*g*. The terminal compartments 23*g* have a bottom to which a transmission member 24*g* is mounted. In respect of electrical polarity for 220V, the transmission member 24*g* is of N connection, while the transmission member 24*g*" on the right side is of L connection. The transmission member 24" of L connection forms a conductive contact surface 241*g*" that extends outward of the terminal compartments 23*g*. Further, the insulation enclosure 11*g* forms, at predetermined locations, a conduction switch 51*g*, a first connection/disconnection plate 52*g*, 52*g*" in electrical connection with live connection of the transmission member 24*g*" of L connection, and a second connection/disconnection plate 53*g*, 53*g*" adjacent to the first connection/disconnection plate 52*g*, 52*g*". A stop board 54*g* is arranged at a location adjacent to the conduction switch 51*g*. The conduction switch 51*g* comprises a slide track 511*g*, a push block 512*g* slidably mounted on the slide track 511*g*, and a conduction and connection plate 513*g* coupled to the push block 512*g*. The conduction and connection plate 513*g* may comprise a fusible metal plate or is made of a conductive substance that becomes open-circuited when subjected to a high temperature. As such, a user may use the conduction switch 51*g* to turn ON/OFF the switching device to realize the function of safety switch. Further, since the switching device provides no selection of polarization arrangement, the user is only allowed to select between "ON" and "OFF" statuses and no selection of polarization is needed. Further, the insulation enclosure 11*g* forms therein a track 70*g* along which the rotary component is rotatable and a centrally-bored insulation plate 71*g*. Further, the terminal compartment 23*g* comprises a safety member 232*g* arranged therein.

Figure 11:
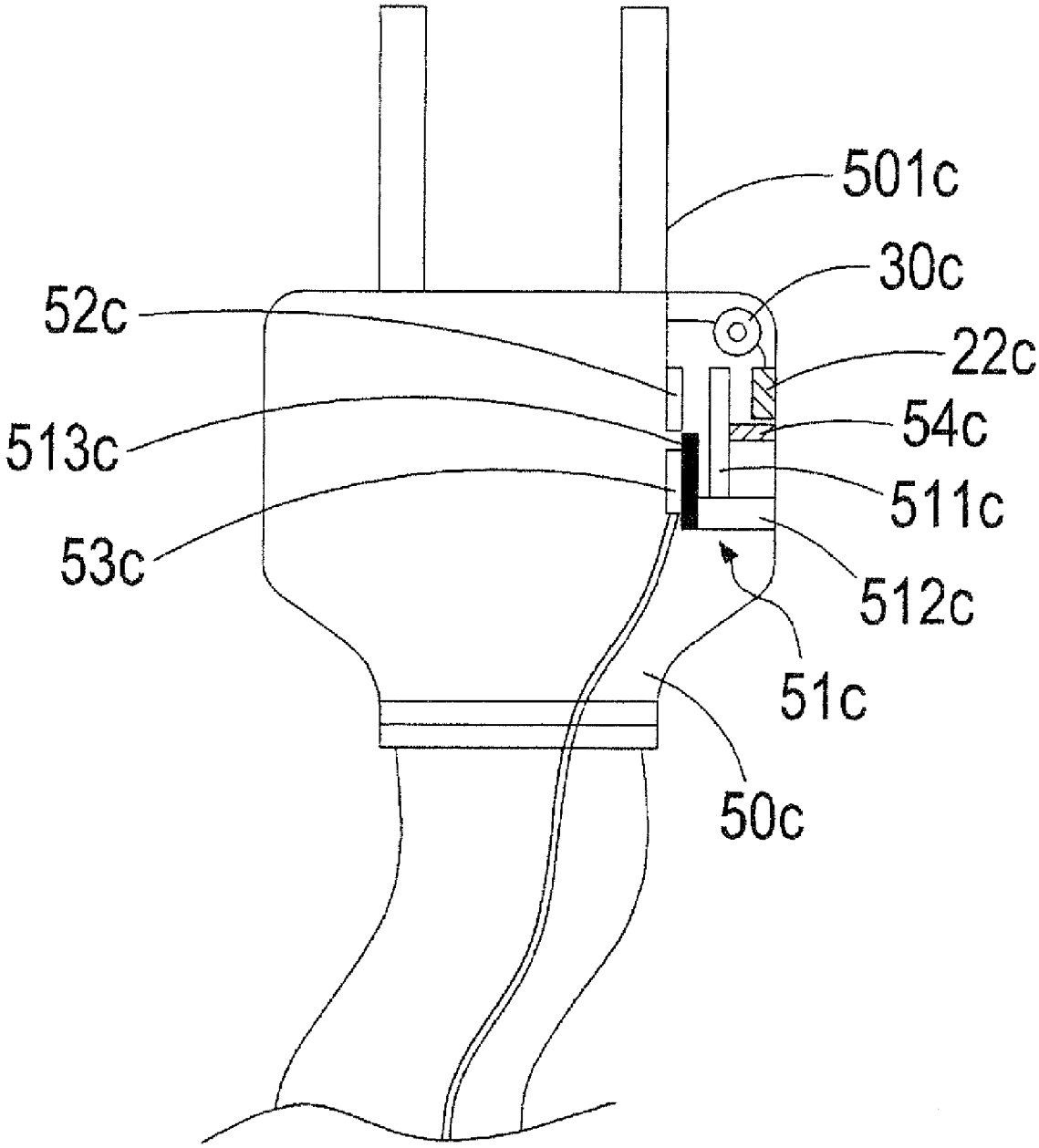
FIG. 11 is a first illustration of a third preferred embodiment according to the present invention.
Figure 11A:
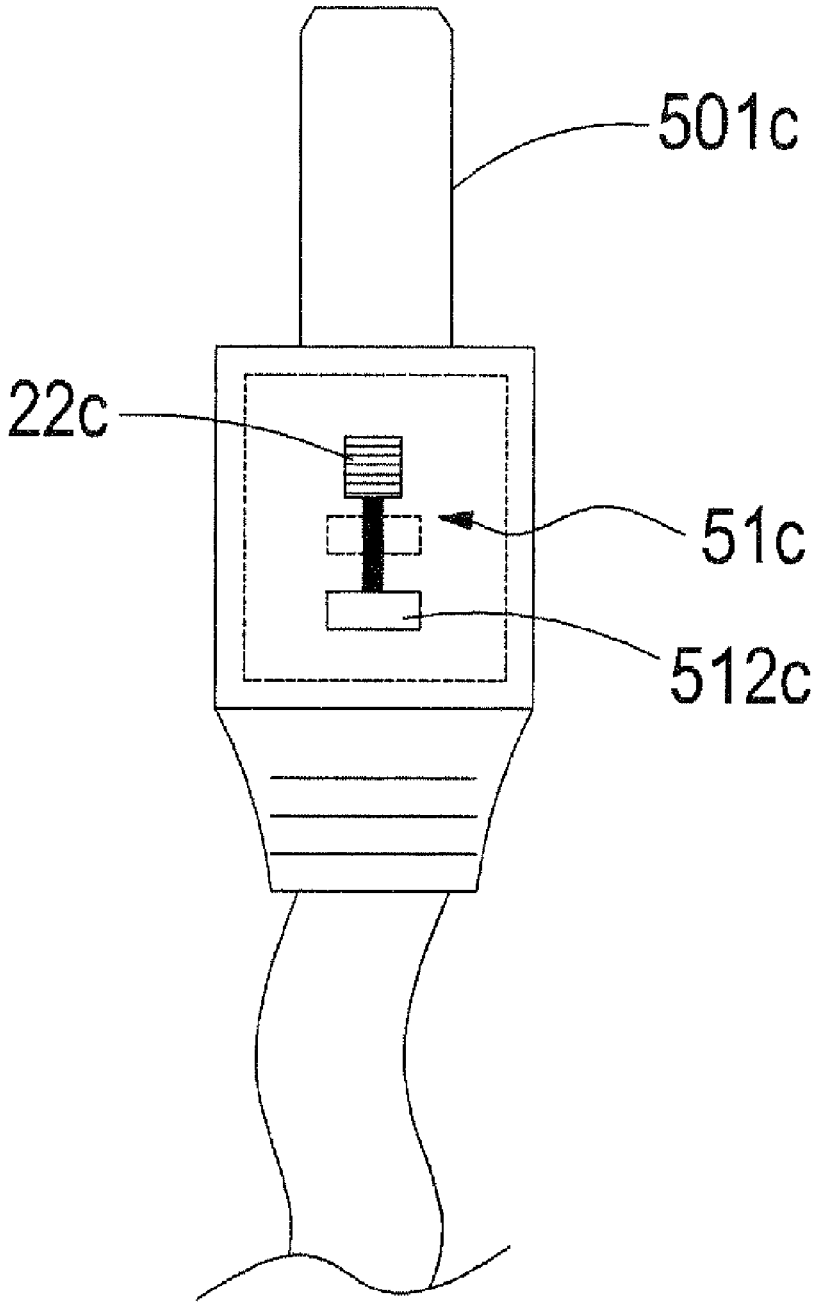
FIG. 11A is a second illustration of the third preferred embodiment according to the present invention.
Figure 12:
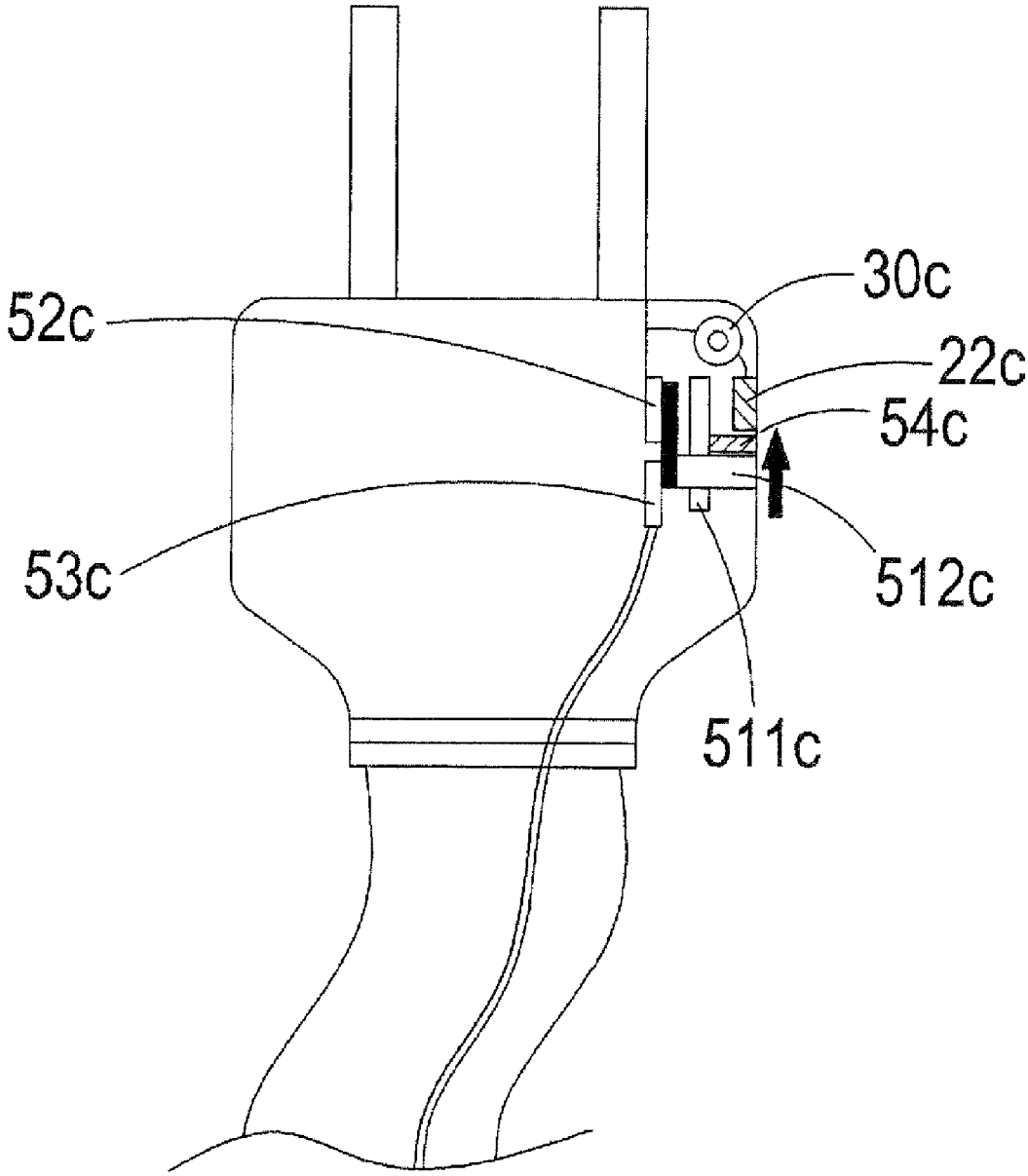
FIG. 12 is a third illustration of the third preferred embodiment according to the present invention.
Figure 13:
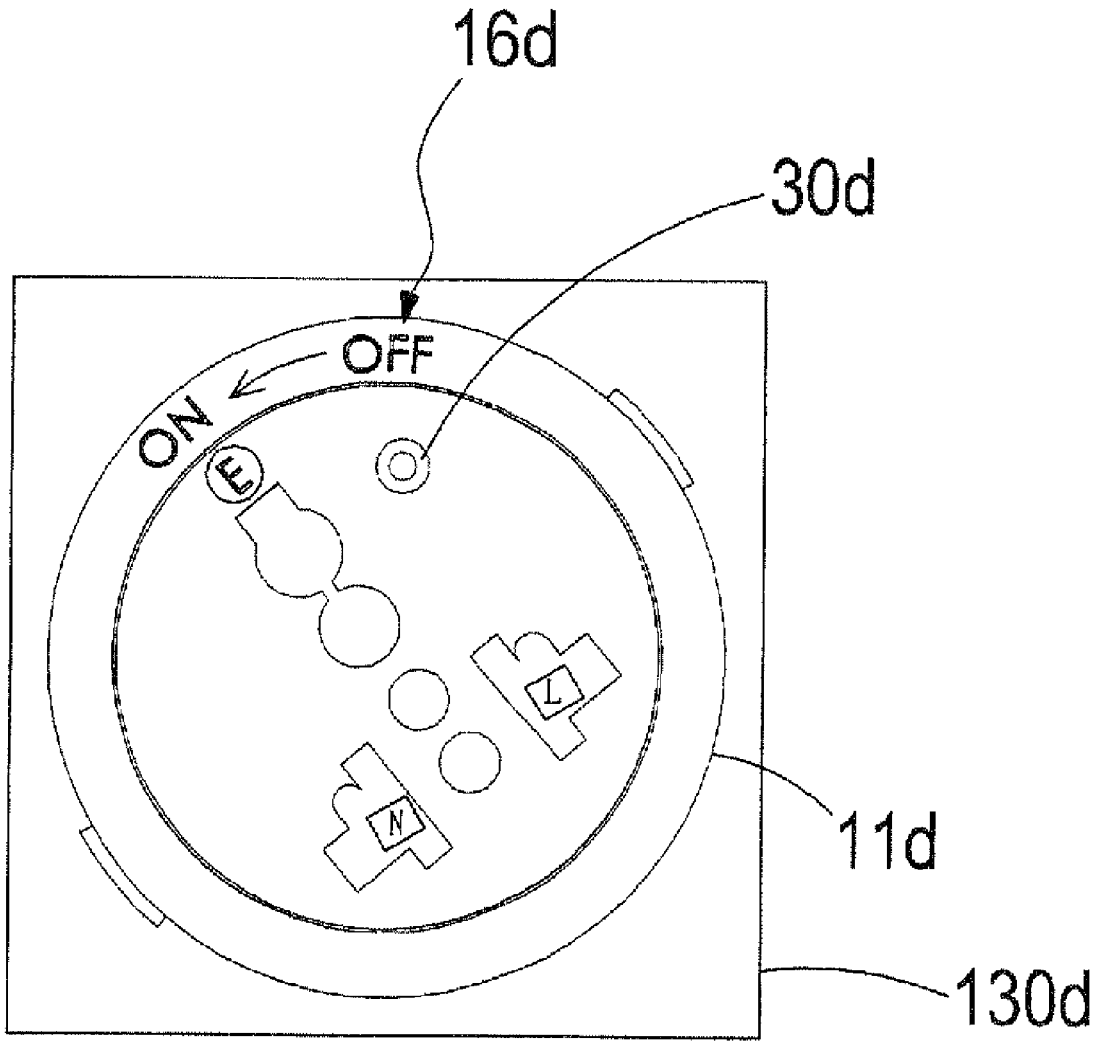
FIG. 13 is a first illustration of a fourth preferred embodiment according to the present invention.

Referring to FIGS. 11, 11A, and 12, which show first, second, and third illustrations of a third preferred embodiment according to the present invention, a power plug 50*c* comprises therein a conduction switch 51*c*, a first connection/disconnection plate 52*c* electrically connected to a live pin 501*c* of the power plug 50*c*, and a second connection/disconnection plate 53*c* adjacent to the first connection/disconnection plate 52*c*. The power plug 50*c* further comprises a touch control detection element 22*c* and an inspection element 30*c* electrically connected to the touch control detection element 22*c*. The inspection element 30*c* is also electrically connected to the live pin 501*c* of the power plug 50*c*. A stop board 54*c* is arranged at one side of the touch control detection element 22*c*. The conduction switch 51*c* comprises a slide track 511*c*, the push block 512*c* slidably mounted on the slide track 511*c*, and a conduction and connection plate 513*c* coupled to the push block 512*c*. The conduction and connection plate 513*c* may comprise a fusible metal plate or is made of conductive substance that becomes open-circuited when subjected to a high temperature. Further, the power plug 50*c* can be a cord-attached power plug 50*c*, which allows a user to connect to a power line, whereby when the user uses a hand to touch the touch control detection element 22*c*, the inspection element 30*c* forms a close circuit through L connection pin (the live pin 501*c*) with the human body for lighting; otherwise, for a N connection pin, no lighting is made. As such, correct polarization can be realized. Further, when the switch of the power plug 50*c* is turned on to make it conducting, the user may operate the push block 512*c*, causing the push block 512*c* sliding along the slide track 511*c* until the push block 512*c* collides and is thus stopped by the stop board 54*c*. At this time, the conduction and connection plate 513*c* makes the first connection/disconnection plate 52*c* and the second connection/disconnection plate 53*c* conducting with each other. Further, since the conduction and connection plate 513*c* comprises a fusible metal plate or a substance that becomes open-circuited when subjected to a high temperature, it can provide the function of fuse for protection against hazard of electricity caused by high temperature.

Figure 14:
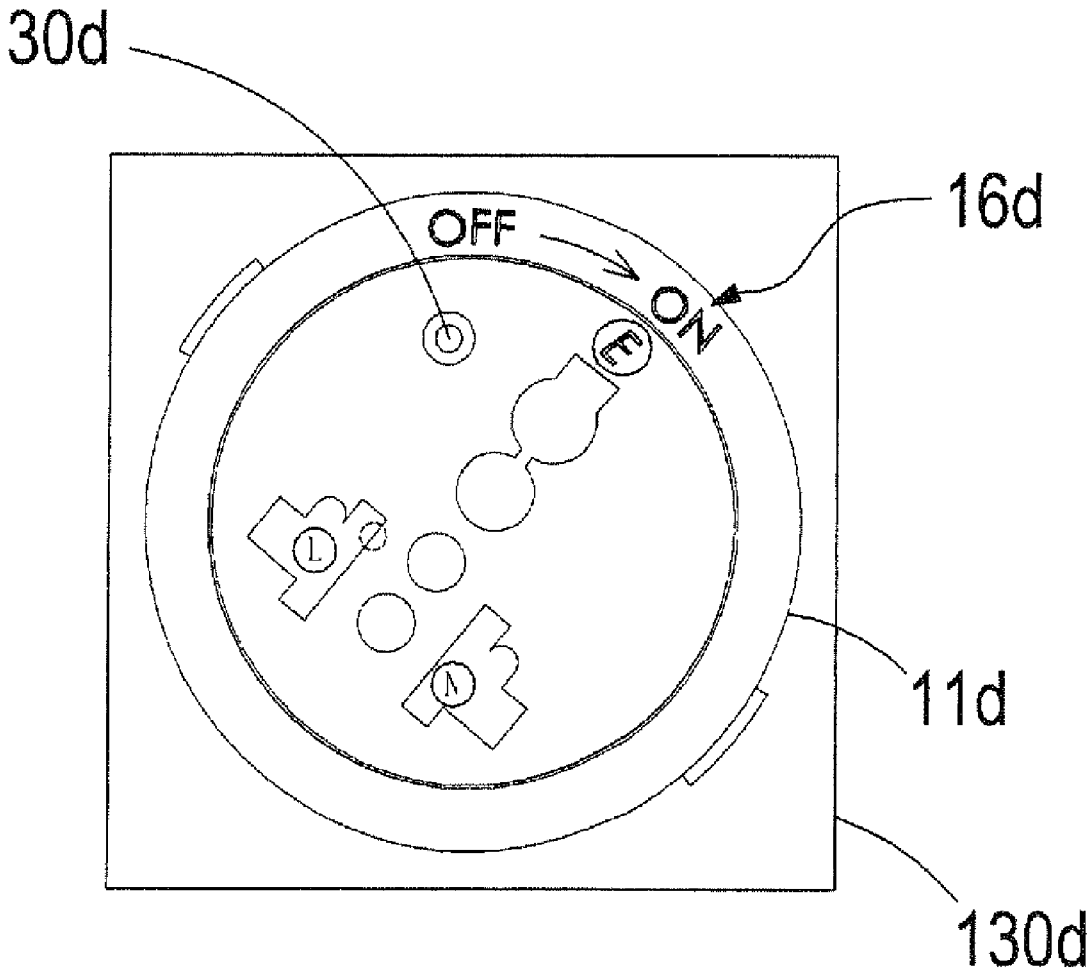
FIG. 14 is a second illustration of the fourth preferred embodiment according to the present invention.
Figure 14A:
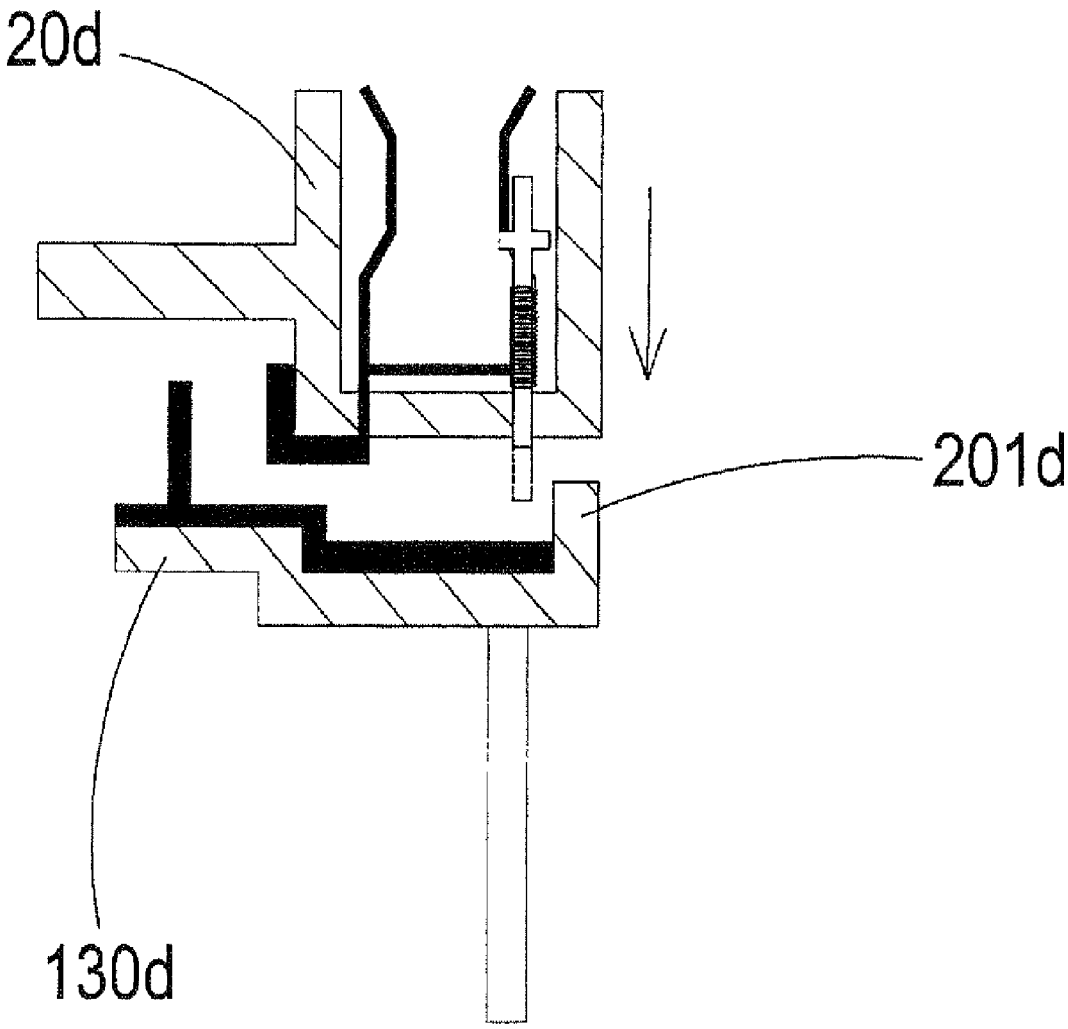
FIG. 14A is a third illustration of the fourth preferred embodiment according to the present invention.
Figure 15:
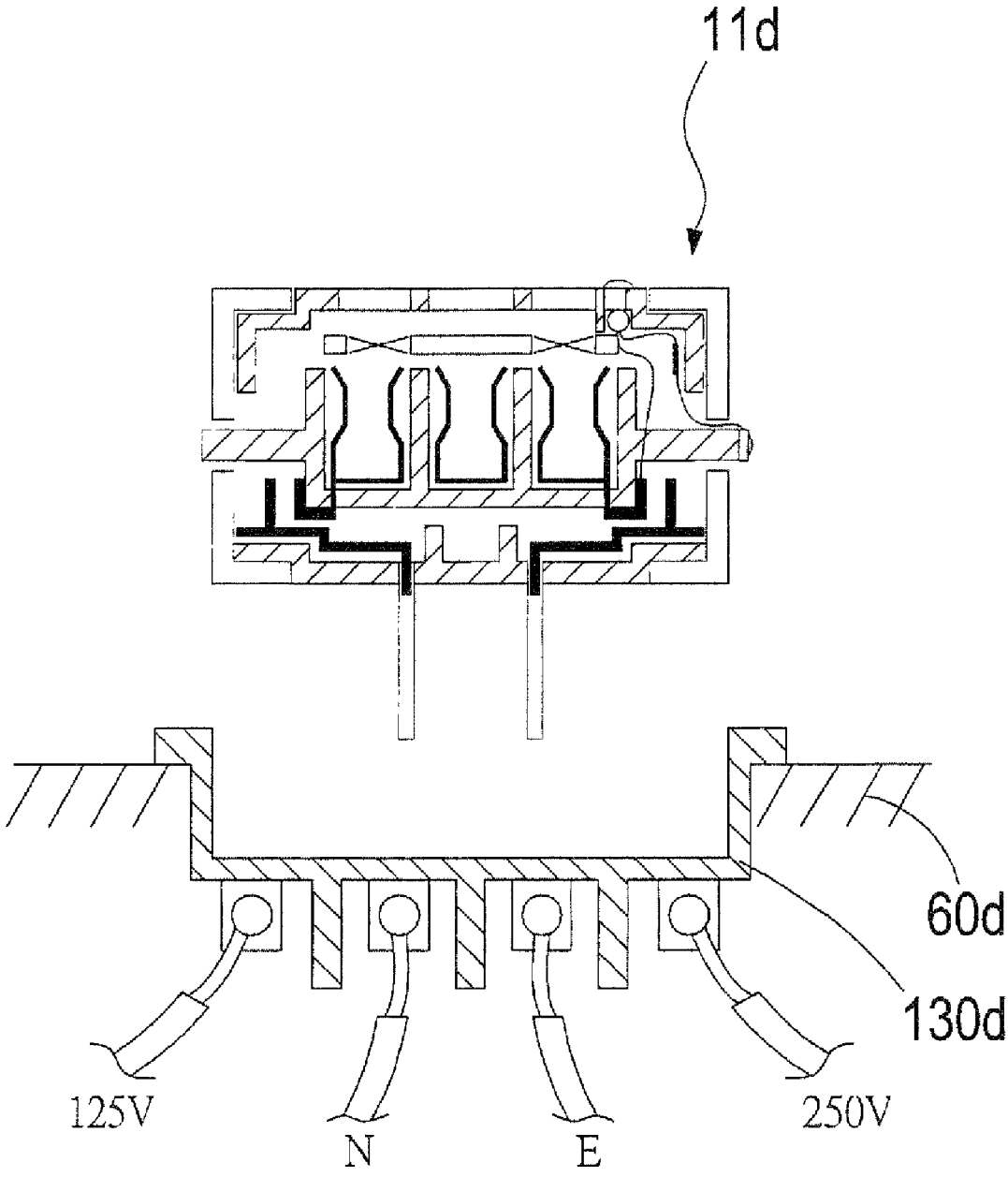
FIG. 15 is an illustration of a fifth preferred embodiment according to the present invention.

Referring to FIGS. 13, 14, 14A, and 15, which are first, second, and third illustrations of a fourth preferred embodiment according to the present invention and an illustration of a fifth preferred embodiment according to the present invention, an insulation enclosure 11*d* forms indication marks 16*d* of "ON" and "OFF" thereon, wherein the indication marks 16*d* provide a uni-directional switch, allowing a user to manually operated for switching on and off, and further allowing a user to select between uni-directional switching for different voltages (220V and 110V), or allowing for use as a safety switch. The operation is easy and prevents incorrect selection and use of voltage level, making it applicable for industrial use. Further, a rotary component 20*d* forms at a predetermined location thereon an inspection element 30*d* (as shown in FIG. 14; alternatively, the inspection element 30*d* being selectively arranged at another site). A mounting board 130*d* can be mounted to the insulation enclosure, or is embedded and concealed in a wall 60*d* or a test platform or an instrument, and allowing for coupling with two voltage levels and polarized power, and allowing for coupling with the mounting board 130*d*, making extremely convenient.

Further, the mounting board 130*d* comprises a stop wall 201*d* that stops leftward rotation of the rotary component 20*d*. This is because Chinese, Japanese, American, and Canadian areas use electrical plugs of 110V and having two flat blade like pins or two flat blade like pins and an earth pin, which allow for rightward rotation only for 125V. The arrangement of the stop wall 201*d* is thus used to prevent leftward rotation of the rotary component 20*d*.

Figure 16:
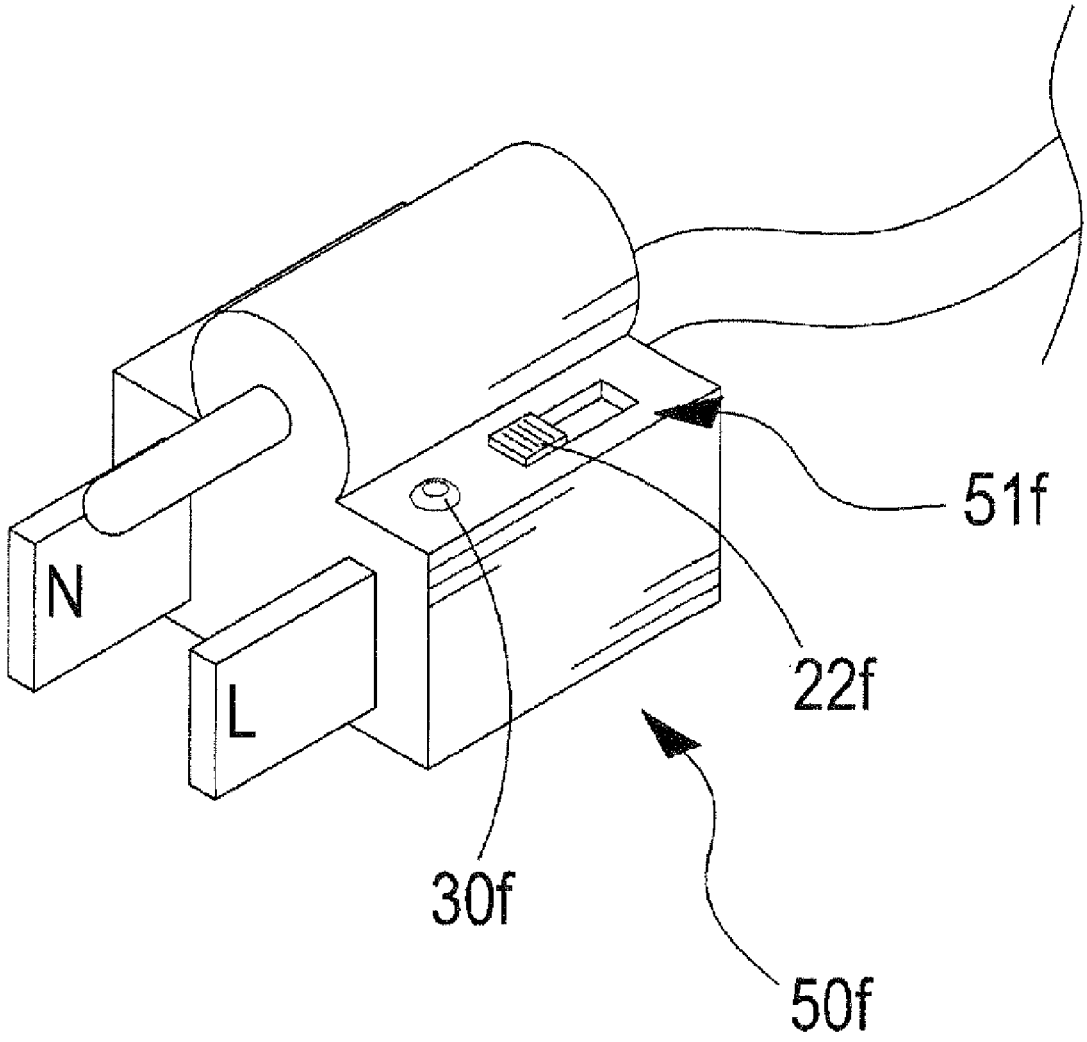
FIG. 16 is a first illustration of a sixth preferred embodiment according to the present invention.
Figure 17:
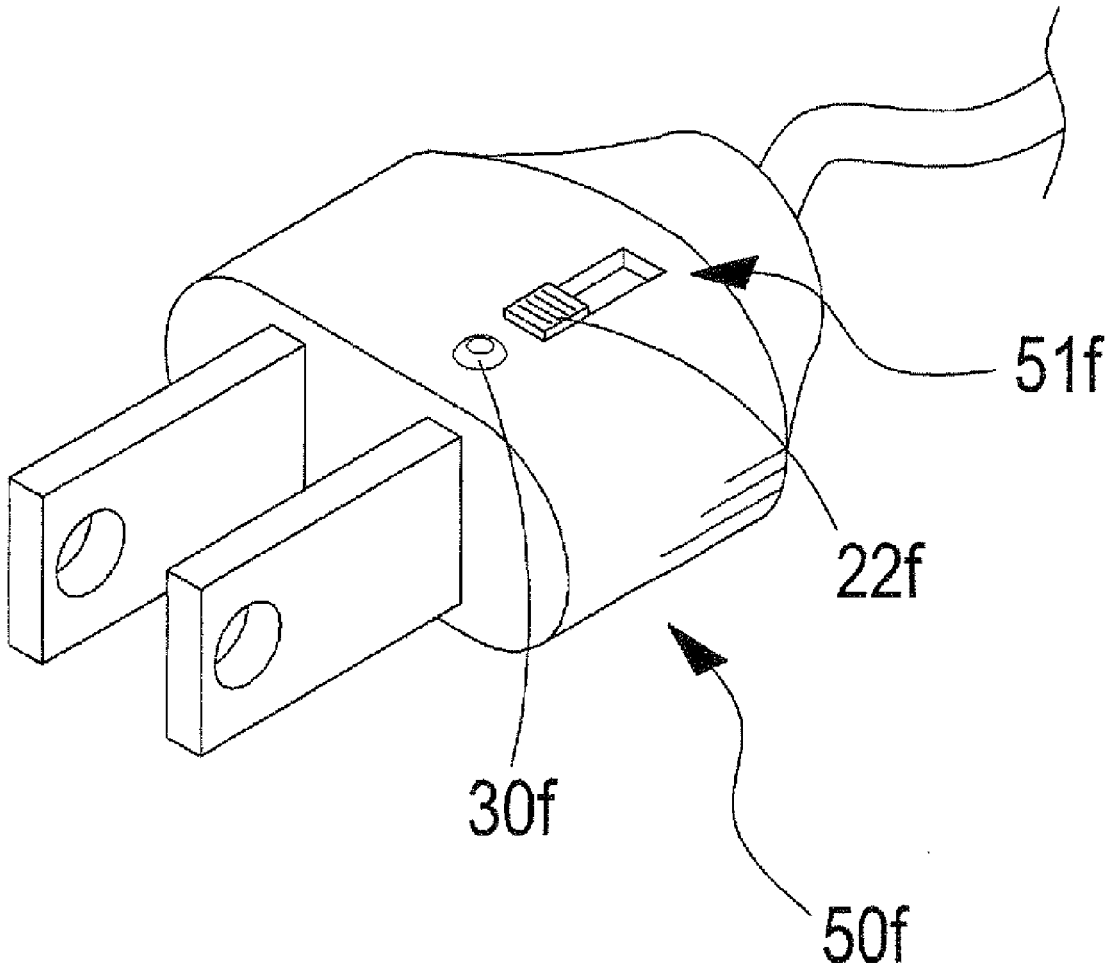
FIG. 17 is a second illustration of the sixth preferred embodiment according to the present invention.
Figure 18:
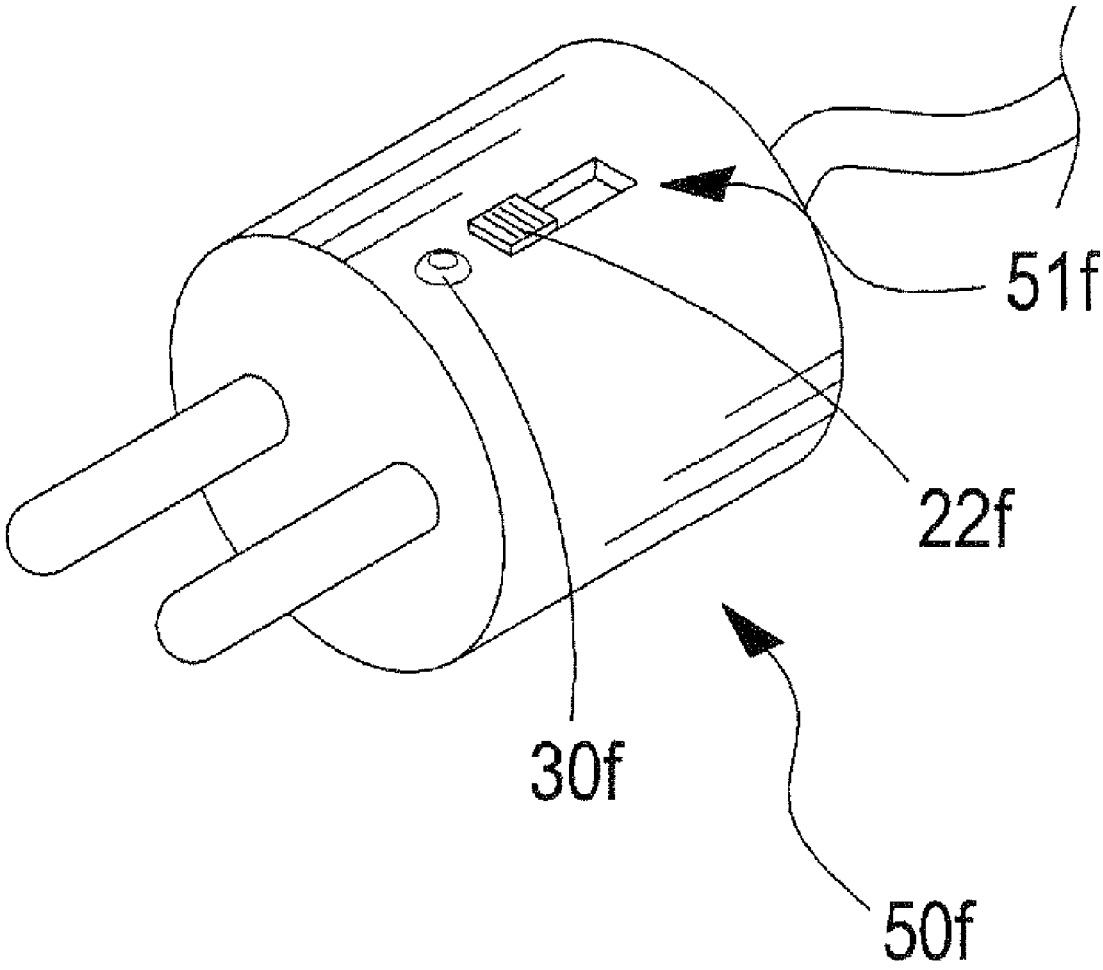
FIG. 18 is a third illustration of the sixth preferred embodiment according to the present invention.

Referring to FIGS. 16, 17, and 18, which are illustrations 1, 2, and 3 of a sixth preferred embodiment according to the present invention, these power plugs 50*f* are of configurations for diverse specifications of power plug in different areas. For example, FIG. 16 shows a 125V three-pin power plug 50*f* commonly used in the USA, Japan, and Taiwan; FIG. 17 shows a 125V/250V two-pin power plug 50*f* commonly used in the Southeastern Asian areas; and FIG. 18 shows a 250V two-pin power plug 50*f* commonly used in European areas. All these power plugs 50*f* can be provided with a conduction switch 51*f*, a touch control detection element 22*f*, and an inspection element 30*f* electrically connected to the touch control detection element 22*f* for inspection and identification of polarization. However, the conduction switch 51*f*, the touch control detection element 22*f*, and the inspection element 30*f* electrically connected to the touch control detection element 22*f* for inspection and identification of polarization are not limited to applications on the power plugs 50*f* discussed, and is also applicable to diverse power plugs 50*f* available for different countries and areas.

In summary, the multi-functional polarity-correcting plugging-coupling switching device according to the present invention can overcome the drawbacks of the conventional devices through the following features:

(1) The present invention suits the needs of contemporary society, allowing people to instantaneously cut off power supply when there is no need to consumer electrical power, and additionally, the device of the present invention provides an additional function of a fuse for protection against risks of electricity and may provide a guide for correct polarization setting, reducing resistivity and suppressing damage of human body caused by electromagnetic radiation, and is also helpful in reduction of energy consumption and carbon generation, making it advanced in environmental conservation.

(2) The arrangement of the conduction switch 51*c* allows a user to selectively cut off power supplied through the power plug 50*c* or to make the power plug conducting and with the arrangement of the touch control detection element 22*c* and the inspection element 30*c*, a user can easily identify the position of the live pin (L), making it helpful in preventing incorrectly conducting or unexpected coupling with wrong polarization, thereby offering a practical improvement.

(3) The device of the present invention is compatible to diverse types of power socket and power plug adopted all countries and areas around the world, making it useful in all the countries and areas, thereby offering improved universality and enhanced functionality.

(4) The device of the present invention is applicable to both two-pin power plugs and three-pin power plugs.

(5) The device of the present invention is operable for plugging coupling, ON/OFF switching, and 360 degree rotation for applications for diverse plugging coupling electrical accessories, including transformer, rectifier, socket, extension cord socket, and adapter.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. A multi-functional polarity-correcting plugging-coupling switching device comprising:

an insulation enclosure, which has a first end to which a polarization-dependent conductive pin set is mounted and an opposite second end forming an opening;

a rotary component received in the insulation enclosure and rotatable, in a limited manner, along a circumferential surface of the opening, the rotary component forming a plurality of terminal compartments electrically connectable to the conductive pin set; and at least one inspection element mounted at a predetermined location on the switching device, the inspection element being in electrical connection with a touch control detection element and a transmission member.

2. The multi-functional polarity-correcting plugging-coupling switching device according to claim 1, wherein the insulation enclosure has a circumferential surface forming at least one position constraint slot, which functions to slidably receive an adjusting and rotating knob projecting from a side surface of the rotary component, the adjusting and rotating knob carrying the touch control detection element thereon, the touch control detection element selectively comprising a touch-control resistor.

3. The multi-functional polarity-correcting plugging-coupling switching device according to claim 1, wherein the rotary component has a surface forming a socket panel.

4. The multi-functional polarity-correcting plugging-coupling switching device according to claim 1, wherein the conductive pin set is mounted to and extends through a mounting board, the mounting board being fixed to an end of the insulation enclosure, the conductive pin set comprising a first pin and a second pin, the first pin and the second pin being respectively connected to conductive members with portions thereof extending through the mounting board, the first pin defining a live pin (L) in a 220V socket or alternatively, a neutral pin (N) in a 110V socket.

5. The multi-functional polarity-correcting plugging-coupling switching device according to claim 1, wherein the conductive members are of polarization positions engageable with extensions of L and N connections in order to allow surface sockets of the rotary component to switch between various polarization settings, the rotary component being adapted to mount to an instrument or a test platform or a plugging coupling device to selectively receive electrical power of 110V and 220V through polarization positions of the mounting board, whereby the rotary component is conducting and outputting various voltage levels and switching between ON and OFF conditions.

6. The multi-functional polarity-correcting plugging-coupling switching device according to claim 1, wherein the transmission member is mounted to a bottom of the terminal compartments and extends outward to form a conductive contact surface.

7. The multi-functional polarity-correcting plugging-coupling switching device according to claim 1, wherein the conductive pin set further comprises an earth pin, the terminal compartments comprising an earth connection compartment connected to the earth pin, a resistive indicator being arranged between the earth connection and the L connection of the live line, whereby whether the indicators lights or not identifies whether the E connection of earth line is correctly connected or not.

8. The multi-functional polarity-correcting plugging-coupling switching device according to claim 1, wherein the terminal compartments comprise a safety member therein, the terminal compartments being adapted to receive a power plug to plug therein, the power plug comprising therein a conduction switch, a first connection/disconnection plate in electrical connection with live connection of the power plug, and a second connection/disconnection plate adjacent to the first connection/disconnection plate.

9. The multi-functional polarity-correcting plugging-coupling switching device according to claim 1, wherein the insulation enclosure forms indication marks of "ON", "OFF", and voltage level adjacent to the opening.

10. The multi-functional polarity-correcting plugging-coupling switching device according to claim 8, wherein the power plug further comprises a touch control detection element and an inspection element electrically connected to the touch control detection element.

11. The multi-functional polarity-correcting plugging-coupling switching device according to claim 10, wherein the inspection element is electrically connected to the live connection of the power plug.

12. The multi-functional polarity-correcting plugging-coupling switching device according to claim 8, wherein the conduction switch comprises a slide track, a push block slidably mounted on the slide track, and a conduction and connection plate coupled to the push block.

13. The multi-functional polarity-correcting plugging-coupling switching device according to claim 10, wherein the touch control detection element further comprises a stop board.

14. The multi-functional polarity-correcting plugging-coupling switching device according to claim 8, wherein the power plug comprises cord-attached power plug, which allows for connection with a power line.

15. The multi-functional polarity-correcting plugging-coupling switching device according to claim 4, wherein the conductive member comprises a fusible metal plate or a conductive substance that becomes open-circuited when subjected to a high temperature.

16. The multi-functional polarity-correcting plugging-coupling switching device according to claim 12, wherein the conduction and connection plate comprises a fusible metal plate or a conductive substance that becomes open-circuited when subjected to a high temperature.

17. The multi-functional polarity-correcting plugging-coupling switching device according to claim 4, wherein the mounting board is adapted to be embedded in a wall or a test platform or an instrument.

18. The multi-functional polarity-correcting plugging-coupling switching device according to claim 1, wherein the inspection element selectively comprises a lighting element or a sounding element.

19. The multi-functional polarity-correcting plugging-coupling switching device according to claim 1, wherein the insulation enclosure forms, at predetermined locations, a conduction switch, a first connection/disconnection plate in electrical connection with live connection of the transmission member, and a second connection/disconnection plate adjacent to the first connection/disconnection plate, a stop board being arranged at a location adjacent to the conduction switch, the conduction switch comprising a slide track, a push block slidably mounted on the slide track, and a conduction and connection plate coupled to the push block.

* * * * *